US011814957B2

(12) United States Patent
Al-Dhafeeri

(10) Patent No.: US 11,814,957 B2
(45) Date of Patent: Nov. 14, 2023

(54) CHARACTERIZE PRODUCTIVE ZONES IN HYDROCARBON WELLBORES

(71) Applicant: Saudi Arabian Oil Company, Dhahran (SA)

(72) Inventor: Abdullah M. Al-Dhafeeri, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/568,172

(22) Filed: Jan. 4, 2022

(65) Prior Publication Data

US 2023/0212945 A1 Jul. 6, 2023

(51) Int. Cl.
*E21B 49/02* (2006.01)
*E21B 49/08* (2006.01)

(52) U.S. Cl.
CPC ..... *E21B 49/0875* (2020.05); *E21B 49/02* (2013.01)

(58) Field of Classification Search
CPC .... E21B 49/0875; E21B 49/087; E21B 49/08; E21B 49/02; E21B 49/00; E21B 33/00; E21B 2200/00
See application file for complete search history.

(56) References Cited

U.S. PATENT DOCUMENTS 9,494,710 B2 11/2016 Gonzales et al.
9,528,364 B2 * 12/2016 Samuel ..... E21B 47/006
2021/0032987 A1 2/2021 Seltzer et al.
2021/0102457 A1 4/2021 Dupont et al.
2021/0165127 A1 * 6/2021 Kibodeaux ..... E21B 49/02
2021/0247534 A1 8/2021 Bo

FOREIGN PATENT DOCUMENTS

CN 110821485 A * 2/2020 ..... E21B 49/00
CN 113047830 A * 6/2021 ..... E21B 47/00

OTHER PUBLICATIONS

U.S. Appl. No. 17/648,050, filed Jan. 14, 2022, Al-Dhafeeri et al.
U.S. Appl. No. 17/648,047, filed Jan. 14, 2022, Al-Dhafeeri et al.

* cited by examiner

*Primary Examiner* — Tarun Sinha
*Assistant Examiner* — James I Burris
(74) *Attorney, Agent, or Firm* — Fish & Richardson P.C.

(57) ABSTRACT

The present disclosure describes a method that includes: accessing production logs at a well location of the carbonate reservoir, the production logs comprising data encoding a flow meter profile and a ratio of water and oil (WOR) at each depth of a range of depths; accessing measurements of core samples extracted from each depth within the range of depths; based on the measurements of core samples, determining a relationship of permeability and porosity at each depth within the range of depths; based on the production logs, analyzing the WOR to determine a derivative WOR' (dWOR/dt) at each depth within the range of depths; and characterizing at least one productive zone at the well location based on a combination of the WOR, the WOR', the flow meter profile, and the relationship of permeability and porosity at each depth within the range of depths.

20 Claims, 22 Drawing Sheets

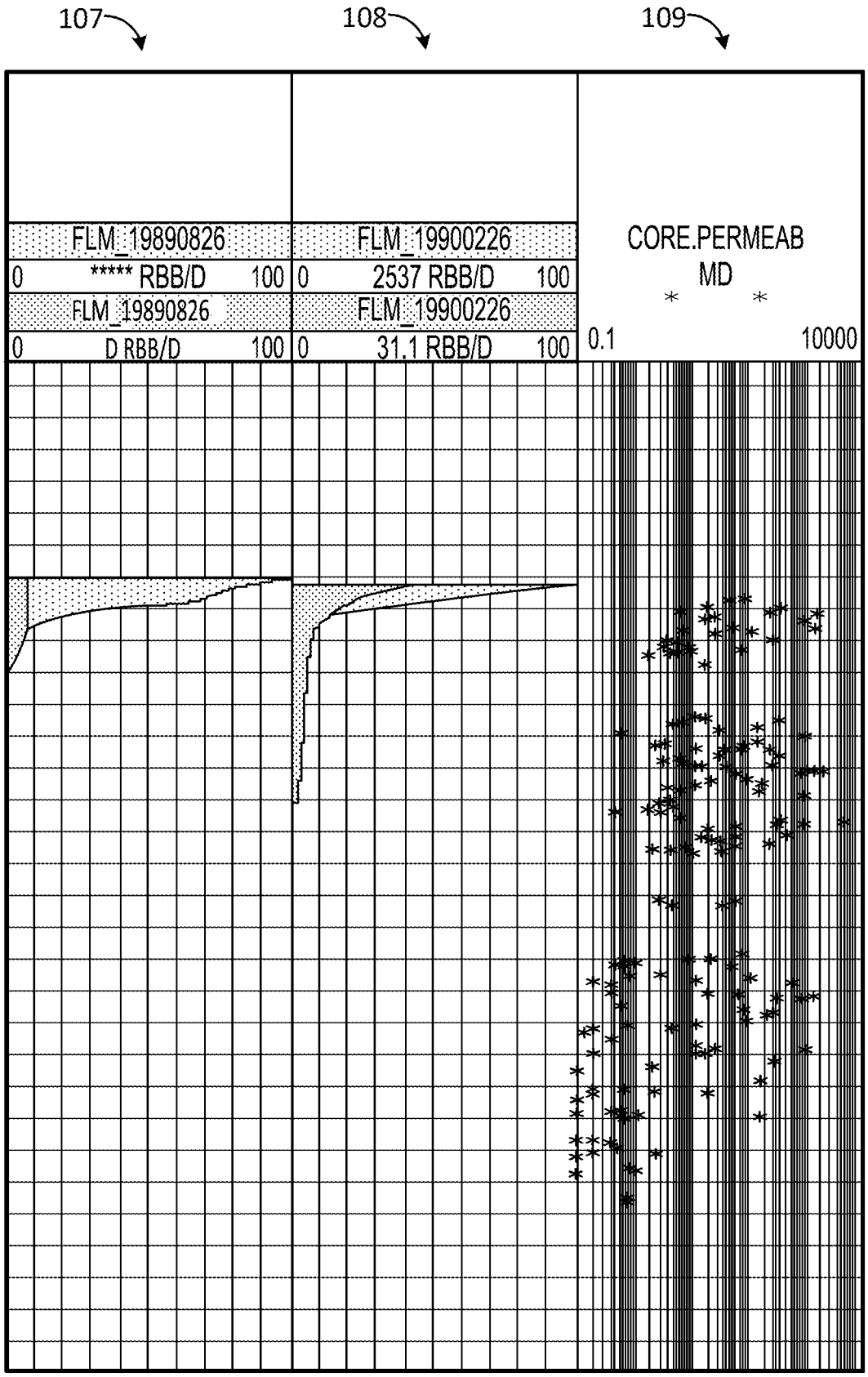
FIG. 1 (Cont.1)

CHARACTERIZE PRODUCTIVE ZONES IN HYDROCARBON WELLBORES

TECHNICAL FIELD

This disclosure generally relates to development and validation of improved analysis to identify and characterize productive zones with high-permeability for oil wells.

BACKGROUND

Productive zones with high permeability carbonate intervals are a subject of interest for reservoir management engineers, as these can be the tell tail signs of the most productive zones. Accurate characterization of productive zones within a carbonate reservoir system can facilitate the interpretation of field data when managing an oil-producing facility.

SUMMARY

In one aspect, implementations provide a computer-implemented method for characterizing a productive zone at a carbonate reservoir, the method including: accessing production logs obtained when drilling at a well location of the carbonate reservoir, the production logs comprising data encoding a flow meter profile and a ratio of water and oil (WOR) at each depth of a range of depths; accessing measurements of core samples extracted from each depth within the range of depths at the well location; based on the measurements of core samples, determining a relationship of permeability and porosity at each depth within the range of depths at the well location; based on the production logs, analyzing the WOR to determine a derivative WOR' (dWOR/dt) at each depth within the range of depths; characterizing at least one productive zone at the well location based on a combination of the WOR, the WOR', the flow meter profile, and the relationship of permeability and porosity at each depth within the range of depths; and sending information encoding the characterization of the at least one productive zone to an operator managing the carbonate reservoir.

Implementations may include one or more of the following features.

The method may further include: determining a distribution of reservoir quality index (RQI), and a distribution of normalized porosity index (NPI) based on the relationship of permeability and porosity at each depth within the range of depths. The method may further include: determining a distribution of flow zone indicator (FZI) based on the distribution of RQI and the distribution of NPI at each depth within the range of depths. The combination may further include the distribution of RQI, the distribution of NPI, and the distribution of FZI.

The combination may further include a cumulative distribution of the WOR, and a cumulative distribution of the WOR' within the range of depths. The flow meter profile may be represented as a percentage of total flow within the range of depths.

The method may further include: establishing a database of productive zones characterized based on the combination of the WOR, the WOR', the flow meter profile, and the relationship of permeability and porosity at each depth within the range of depths. The method may further include: correlating the database of productive zones with actual production logs; refining the combination of the WOR, the WOR', the flow meter profile, and the relationship of permeability and porosity based on correlation results; and characterizing at least one productive zone at the well location based on the refined combination.

In another aspect, implementations provide a computer system comprising one or more computer processors configured to perform operations of: accessing production logs obtained when drilling at a well location of the carbonate reservoir, the production logs comprising data encoding a flow meter profile and a ratio of water and oil (WOR) at each depth of a range of depths; accessing measurements of core samples extracted from each depth within the range of depths at the well location; based on the measurements of core samples, determining a relationship of permeability and porosity at each depth within the range of depths at the well location; based on the production logs, analyzing the WOR to determine a derivative WOR' (dWOR/dt) at each depth within the range of depths; characterizing at least one productive zone at the well location based on a combination of the WOR, the WOR', the flow meter profile, and the relationship of permeability and porosity at each depth within the range of depths; and sending information encoding the characterization of the at least one productive zone to a display device of the computer system for an operator managing the carbonate reservoir.

Implementations may include one or more of the following features.

The operations may further comprise: determining a distribution of reservoir quality index (RQI), and a distribution of normalized porosity index (NPI) based on the relationship of permeability and porosity at each depth within the range of depths. The operations may further comprise: determining a distribution of flow zone indicator (FZI) based on the distribution of RQI and the distribution of NPI at each depth within the range of depths. The combination may further include the distribution of RQI, the distribution of NPI, and the distribution of FZI.

The combination may further include a cumulative distribution of the WOR, and a cumulative distribution of the WOR' within the range of depths. The flow meter profile may be represented as a percentage of total flow within the range of depths. The operations may further comprise: establishing a database of productive zones characterized based on the combination of the WOR, the WOR', the flow meter profile, and the relationship of permeability and porosity at each depth within the range of depths.

The operations may further include: correlating the database of productive zones with actual production logs; refining the combination of the WOR, the WOR', the flow meter profile, and the relationship of permeability and porosity based on correlation results; and characterizing at least one productive zone at the well location based on the refined combination.

In yet another aspect, implementations provide non-transitory computer-readable medium, comprising software instructions, which, when executed by a computer processor, causes the computer processor to perform operations of: accessing production logs obtained when drilling at a well location of the carbonate reservoir, the production logs comprising data encoding a flow meter profile and a ratio of water and oil (WOR) at each depth of a range of depths; accessing measurements of core samples extracted from each depth within the range of depths at the well location; based on the measurements of core samples, determining a relationship of permeability and porosity at each depth within the range of depths at the well location; based on the production logs, analyzing the WOR to determine a derivative WOR' (dWOR/dt) at each depth within the range of depths; characterizing at least one productive zone at the well location based on a combination of the WOR, the WOR', the flow meter profile, and the relationship of permeability and porosity at each depth within the range of depths; and sending information encoding the characterization of the at least one productive zone to an operator managing the carbonate reservoir.

Implementations may provide one or more of the following features.

The operations may further comprise: determining a distribution of reservoir quality index (RQI), and a distribution of normalized porosity index (NPI) based on the relationship of permeability and porosity at each depth within the range of depths, and determining a distribution of flow zone indicator (FZI) based on the distribution of RQI and the distribution of NPI at each depth within the range of depths, wherein the combination further includes the distribution of RQI, the distribution of NPI, and the distribution of FZI.

The combination may further include a cumulative distribution of the WOR, and a cumulative distribution of the WOR' within the range of depths, and wherein the flow meter profile is represented as a percentage of total flow within the range of depths.

The operations may further include: establishing a database of productive zones characterized based on the combination of the WOR, the WOR', the flow meter profile, and the relationship of permeability and porosity at each depth within the range of depths; correlating the database of productive zones with actual production logs; refining the combination of the WOR, the WOR', the flow meter profile, and the relationship of permeability and porosity based on correlation results; and characterizing at least one productive zone at the well location based on the refined combination.

Implementations according to the present disclosure may be realized in computer implemented methods, hardware computing systems, and tangible computer readable media. For example, a system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions.

The details of one or more implementations of the subject matter of this specification are set forth in the description, the claims, and the accompanying drawings. Other features, aspects, and advantages of the subject matter will become apparent from the description, the claims, and the accompanying drawings.

DESCRIPTION OF DRAWINGS

Like reference numbers and designations in the various drawings indicate like elements.

DETAILED DESCRIPTION

Figure 1:
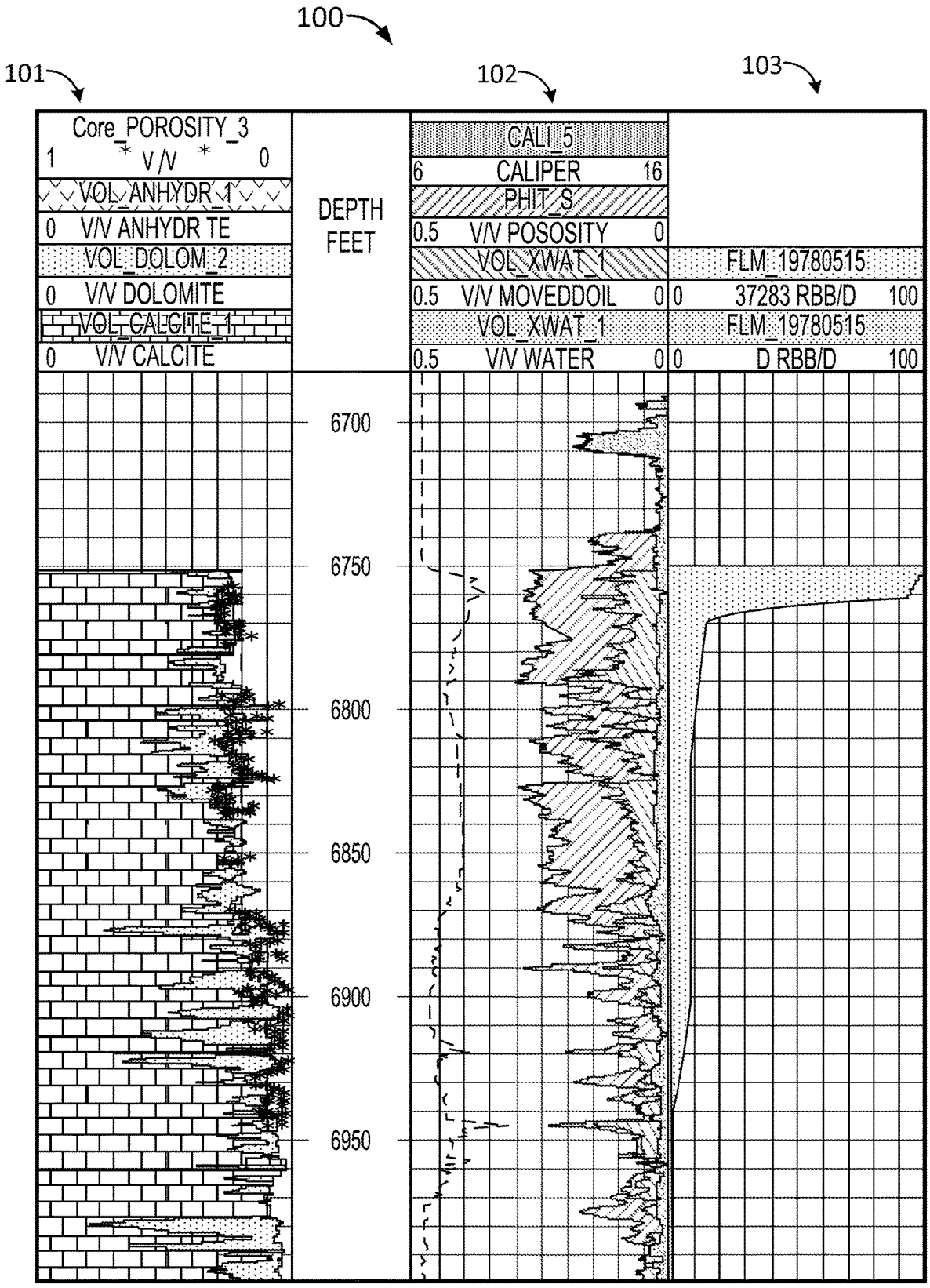
FIG. 1 shows a flowmeter profile for a well in a carbonate reservoir.
Figure 1:
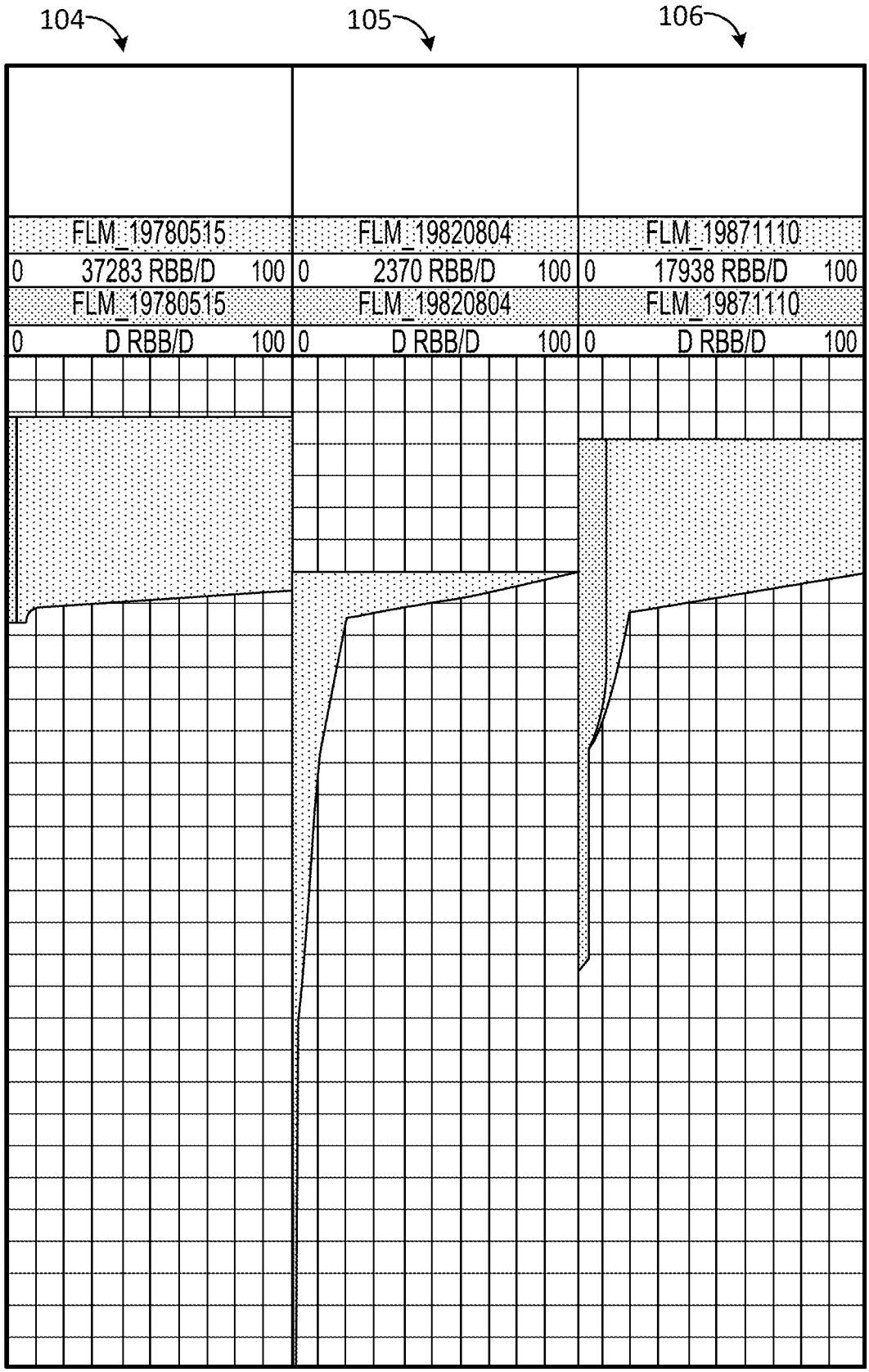

The disclosed technology is directed to improved characterization of productive zones of a carbonate reservoir, Examples of the present disclosure can validate a multivariate relation by combining core analysis, flowmeter and Water-Oil-Ratio (WOR') derivative curves to identify and to characterize productive zones with high-permeability for oil wells. Various implementations can incorporate characterization of productive zones with high-permeability using conventional petrophysical tests in conjunction with flowmeter measurements and a derivative of WOR (WOR') from production profile.

These implementations can provide a characteristic classification based on a thorough synergistic and comprehensive approach that evaluates information at the core scale, which uses special core analyses of multidirectional porosity and permeability, and a derivative of WOR (WOR') from production profile in oil wells at wellbore scale, which uses open-hole flowmeter results. The implementations can further integrate the cumulative distribution of reservoir quality index (ROI), and flow zone indicator (FZI) to differentiate between zones in terms of location and properties. Additionally, the implementations can use open-hole flowmeter data with derivative of WOR (WOR') to capture pay zones (Productive intervals) with high-permeability and/or fractures features, even in the heterogeneous carbonate reservoirs.

Identifying the dominant reservoir oil production mechanisms can be an integral part of reservoir management. Such identification is expected to align with cumulative distribution of reservoir quality index (RQI), and flow zone indicator (FZI) in terms of high potential productive zone across the wellbore. A log-log curve of a water-oil-ratio (WOR) produced versus production time may be utilized as a diagnostic curve. Various implementations can combine Log-Log derivative curves of WOR derivative (WOR') with core analysis and flowmeter measurements to develop a relationship between the derivatives curve and the cumulative distribution of reservoir quality index (ROI), and flow zone indicator (FZI). These implementations can analyze the behaviors of the WOR' and the cumulative distribution of reservoir quality index (PAN), and flow zone indicator (FZI) curves in various depth to interpret the behavior observed and building a correlation to capture the productive zones across the reservoirs. Some implementations can explore the correlation to potentially interchange the results while undertaking data interpretation to identify the productive zones. These implementations can be applied to any oil carbonate reservoir system.

Implementations can integrate sufficiently large and small level of data measurements from core analysis and production profile by way of correlations to reflect the reservoir quality and interval contribution across the reservoirs as well as the wellbores of the reservoirs. The implementations can combine various properties of log-log curves of the WOR' and core analysis with flowmeter profile to develop a relationship between the derivative curve of WOR' and the cumulative distribution of reservoir quality index (RQI), and flow zone indicator (FZI). By establishing this relationship for heterogeneous systems, productive zones can be represented with better reservoir quality in terms of a permeability streak (super-K), a rock matrix, multi-layers, fractures, and faults effects. Finally, the interpretation methodology can recognize the mechanism of identifying and characterizing productive zones with high-permeability carbonate zones for oil wells.

Implementations can identify and characterize productive zones with high permeability based on core data analysis and production log data integrated with Water-Oil-Ratio (WOR') derivative curve. While the productive zones thickness may not be effectively obtained by using Amaefule's method for FZI identification, the cumulative reservoir properties, as determined from core data analysis, can be used as additional tools to estimate well productivity and as measurements of reservoir heterogeneity. Based on flowmeter data combined with Water-Oil-Ratio (WOR') derivative curve, implementations can obtain the match among the cumulative distributions of reservoir quality index (RQI), flow zone indicator (FZI), flowmeter data combined with Water-Oil-Ratio (WOR') derivative curve for subject wells under investigation. However, results from the implementations demonstrate considerable variation in RQI and FZI from well to well and fair variation within the same well. Furthermore, the productive zones with high permeability at different depths and zone locations had high permeability, FZI, and RCA with almost matching trend and negative values from Water-Oil-Ratio (WOR') derivative curve.

Notably, a carbonate reservoir can be a highly heterogeneous if containing faults, fractures and high-permeability zones. The productive zones with high-permeability intervals can be identified and characterized for effective reservoir management. These zones can have a significant impact on the overall behavior of the reservoir, especially when secondary recovery systems are used. For example, some wells may experience a high production rate due to presence of high velocity flow conduits. Hence, improved description of the productive zones with high-permeability in oil field can provide better understanding of reservoir behavior and better field development.

Implementations may facilitate the identification and characterization of the productive zones with high permeability and improved reservoir quality based on core analysis and open-hole flowmeter data combined with Water-Oil-Ratio (WOR') derivative curve. The implementations may incorporate a version of the Carman-Kozeny equation to identify and characterize productive zones with high-permeability in the heterogeneous carbonate reservoir. The method can subdivide the reservoir into distinct petrophysical types and each distinct reservoir type can have a unique FZI value, RQI, and normalized porosity index (NPI) as shown in equations 1-3. Some implementations also concentrate on formation evaluation at the core scale using special core analyses, and at the wellbore scale using on open-hole flowmeter results combined with Water-Oil-Ratio (WOR') derivative curve. Integration of flowmeter profile, the cumulative distribution of permeability, porosity, ROI, FZI and Water-Oil-Ratio (WOR') derivative curve was carried out to differentiate between zones in terms of location, lithology and reservoir quality.

Conventional core analysis data may be considered a key component for analyzing the reservoir potential with a limitation because it can depend on the core samples obtained from different depths. However, some core samples from high permeability zones may not be cored due to the highly fractured nature. Therefore, conventional core analysis may be useful as far as providing some observations that cannot be detected with other tools. The need for accurate characterization is prevalent, not only because of geologic complexity but also because of the need to enhance field development.

Continuous flowmeter data are usually obtained in wells with openhole completions in order to assess reservoir sweep efficiency in all the zones. This data can be used as the basis for comparisons with porosity, permeability. RQI and FZI, obtained from a modified Carman-Kozeny method proposed by Amaefule. This method can operate on the measurements already available e.g., core analysis data and flowmeter measurements).

Implementations of the present disclosure relate to characterization of productive zones with high permeability by using historical analysis charts in semi-steady states regime to analyze the water-oil ratio (WOR) and its derivative WOR' (dWOR/dt) versus a time as one aspect with a combination of flowmeter profile, the cumulative distribution of permeability; porosity, RQI, FZI. The implementations can characterize productive zones with flow path (geometry) in reservoirs by describing features of flow such as radial and/or linear type of regimes. The flow patterns can include more complex condition linked to near wellbore with oil production in multilayer reservoirs. Therefore, the implementations offer a qualitative analysis of water-oil ratio (WOR) performance data and its derivative WOR' (dWOR/dt) combined with a combination of flowmeter profile, the cumulative distribution of permeability, porosity, RQI, FZI in terms of monitoring changes in wellbore conditions, reservoir properties as well as characterization of boundary conditions to improve well evaluation with the improved diagnosis of oil source.

Core Plugs and Conventional Measurements

To prepare for core analysis, plug samples were cleaned and dried, and then used to measure values of porosity and permeability. Solvents such as toluene, naphtha, and xylene were used to clean the plugs. Porosity values were obtained by using the Boyle's Law method. The method is capable of measuring grain volume by helium porosimeter and bulk volume by liquid displacement technique, while Darcy's Law method is applied to measure permeability values using a gas permeameter apparatus at ambient conditions under steady-state flow.

Permeability and Porosity Relationship

Permeability and porosity have been shown as significant reservoir parameters for water flooding projects and for numerical reservoir simulation. Core analysis methods may use the technique of cross-plotting the logarithms of permeability versus porosity, fitting a regression line on this plot, and then estimating permeability for the intact rock. This technique is often used for modeling rock permeability. However, two misinterpretations of results can affect the validity of this method. First, the relationship between the logarithms of permeability versus porosity is considered to be linear. Secondly, using core porosity values, which are determined in the laboratories or by logs on this plot to predict permeability, would involve a scaling agreement between the small-scale level (core plug) and the large-scale level (wellbore). Then, this regression equation is applied in the un-cored wells to derive permeability. Subdividing the reservoir into several depositional facies and developing a porosity-permeability relationship for each facies can enhance the likelihood of success of this technique. This technique may be applied with the assumption that the facies can be estimated in the non-cored wells; even though permeability is a function of pore geometry; grain size, clay/mud content, and other elements in a reservoir.

Selection of Amaefule's Method

Implementations may incorporate Amaefule's method because this method involves only information already available that is related to identifying productive zones with high permeability. Therefore, Amaefule's method can be incorporated as an additional tool to provide observations that can help in characterizing the most productive zones across reservoir. The hydraulic unit concept, developed by Amaefule's method, was leveraged to identify, and characterize productive and high reservoir rock quality especially with high permeability. The method may use a modified version of the Carman-Kozeny's equation that operate on the mean hydraulic radius. The method can be applied to carbonate reservoirs as well as to clastic rocks. The method can subdivide the reservoir into distinct petrophysical types and each distinct reservoir type can have a unique FZI value, RQI, and normalized porosity index (NPI).

Implementations may combine porosity and permeability data in terms of, for example, FZI, RQI, and NPI values. These values can be conveniently applied to routine core analysis data to address the differences between reservoir core samples and reservoir zones at particular depth. For the most part, no single indicator can provide sufficient evidence to confirm a prediction of the characterization and location of productive zones with high permeability. However, in most cases, accurate location and evidence of productive zones with high permeability can be accomplished through a suite of techniques such as lost circulation data, caliper log and core inspection. Some implementations may incorporate alternative approaches using the Amaefule's method to identify productive zones with a limitation. Therefore, a combination of flow meter profile and production history with Water-Oil-Ratio (WOR') derivative curve can facilitate better identification of productive zones with high permeability.

Implementations incorporating Amaefule's method may be based on calculating two terms, RQI, and NPI, defined as follows:

$$RQI = 0.0314\sqrt{\frac{k}{\phi}}, \tag{1}$$

$$NPI = \frac{\phi}{1-\phi}, \tag{2}$$

$RQI$: Reservoir Quality Index, μm $K$: Permeability, $md$ $\phi$: porosity, Volume fraction $NPI$: Normalized Porosity Index, fraction RQI and NPI can be used to determine FZI, which can then be used to quantify the flow character of a reservoir, thereby revealing a relationship between petropysical properties at the small scale, such as core plugs, and large-scale properties such as wellbore level. These terms are described as follow:

$$FZI = \frac{RQI}{NPI}, \tag{3}$$

Productive Zones with High-Permeability Prediction Techniques

Implementations can identify productive zones with high permeability in oil bearing reservoir through several methods such as caliper logs, production logs, and core analysis. By comparing the abnormal properties of high permeability zones to matrix rock properties, the implementations can focus on using core analysis techniques in terms of RQI, NPI, and FZI, The present disclosure may further discuss other methods such as caliper logs, flowmeter logging, and water-oil ratio (WOR) performance data and its derivative WOR'(dWOR/dt) with oil field case studies.

Caliper Logs

By way of illustration, one of the most direct and effective methods for detecting fractures and/or high permeability zones in boreholes is the use of caliper logs. Hole diameter can be a sign of fractures, channels and high permeability zones; subsurface, anomalous physical properties that can be detected remotely by caliper logs.

Flowmeter Logging

Additionally, the production log tool can be used in characterizing productive zones with high permeability and its contribution to production profile across reservoir intervals. The tremendous advantage of the flowmeter log include its capability to obtain the quantitative measurements. Further, this logging measurement can show how the population of high permeability zones intersected by a borehole is related to flow path in the surrounding rock. The production characteristics of each zone may depend on the wellbore stimulation (skin factor), and total flow rate where, the flow rate into each zone can be proportional to its permeability and its pressure differences. Implementations may incorporate a combination of characterization of productive zones with high permeability based on flowmeter log and core data analyses at different scales combined with a behavior of Water-Oil Ratio (WOR) derivative curve.

Water-Oil Ratio (WOR) and its Derivative WOR' Curves

Implementations may further include the comparison of results between analytical semi steady state curves of Water-Oil-Ratio (WOR) and its time derivative (WOR') with respect to time and a diagnostic read out base on core analysis and flowmeter profile type curve. The characterization of productive zones from reservoir point of view by analytical methods can be very useful when combined with a diagnostic base from porosity, permeability, ROI and FZI, which are obtained from a modified Carman-Kozeny method proposed by Amaefule to identify productive zones with high permeability, Oil Field Case Studies To carry out the techniques listed above, implementations may obtain actual field logs and flowmeter performance data and production data in terms of oil and water rates for wells with high permeability zones.

Well Description

An example of a carbonate reservoir has been undergoing water injection to maintain pressure and to increase recovery efficiency. Two oil production wells were selected from this reservoir as illustrative examples. These two wells are vertical with 6 in. openhole completions over an interval of nearly 200 to 250 ft, Wellbore volumes are 300 to 400 bbls. The reservoir contains 20 to 75 wt % dolomite, with a permeability range of 250 to 950 md and porosity varying from 10 to 25%. The temperature of the formation ranges from 150 to 250° F. Reservoir properties for these wells (first well as well A and second well as well B) are listed below in Tables 1 and 2.

TABLE 1

(Reservoir Properties for the first well, well A)

| | | |
|---|---|---|
| Depth | 6,541 | ft |
| q | 2,904 | B/D |
| h | 244 | ft |
| $p_i$ | 2,553 | psi |
| $k_o$ | 255 | md |
| $k_w$ | 30 | md |
| φ | 0.15 | |
| B | 1.34 | RB/STB |
| μ | 0.74 | cp |
| r | 1,320 | ft |
| $C_t$ | 2.58E−05 | $psi^{-1}$ |
| $r_w$ | 0.25 | ft |

TABLE 2

(Reservoir Properties for the first well, well B)

| | | |
|---|---|---|
| Depth | 6,263 | ft |
| q | 11,589 | B/D |
| h | 203 | ft |
| $p_i$ | 2,701 | psi |
| $k_o$ | 496 | md |
| $k_w$ | 29 | md |
| φ | 0.114 | |
| B | 1.29 | RB/STB |
| μ | 0.99 | cp |
| r | 1,320 | ft |
| $C_t$ | 1.36E−05 | $psi^{-1}$ |
| $r_w$ | 0.25 | ft |

Caliper Log Evaluation

Figure 2:
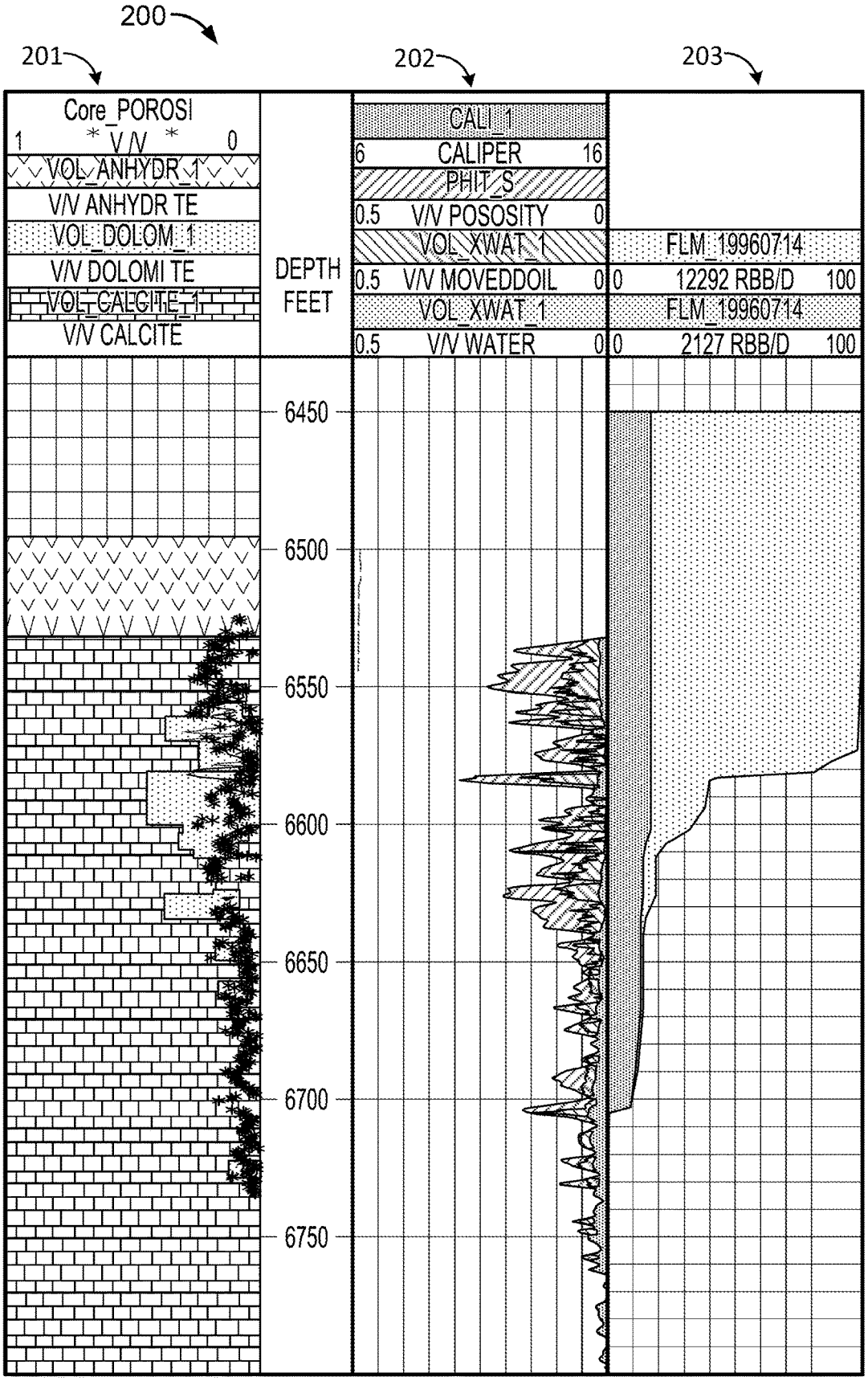
FIG. 2 shows a flowmeter profile for another well in a carbonate reservoir.
Figure 2:
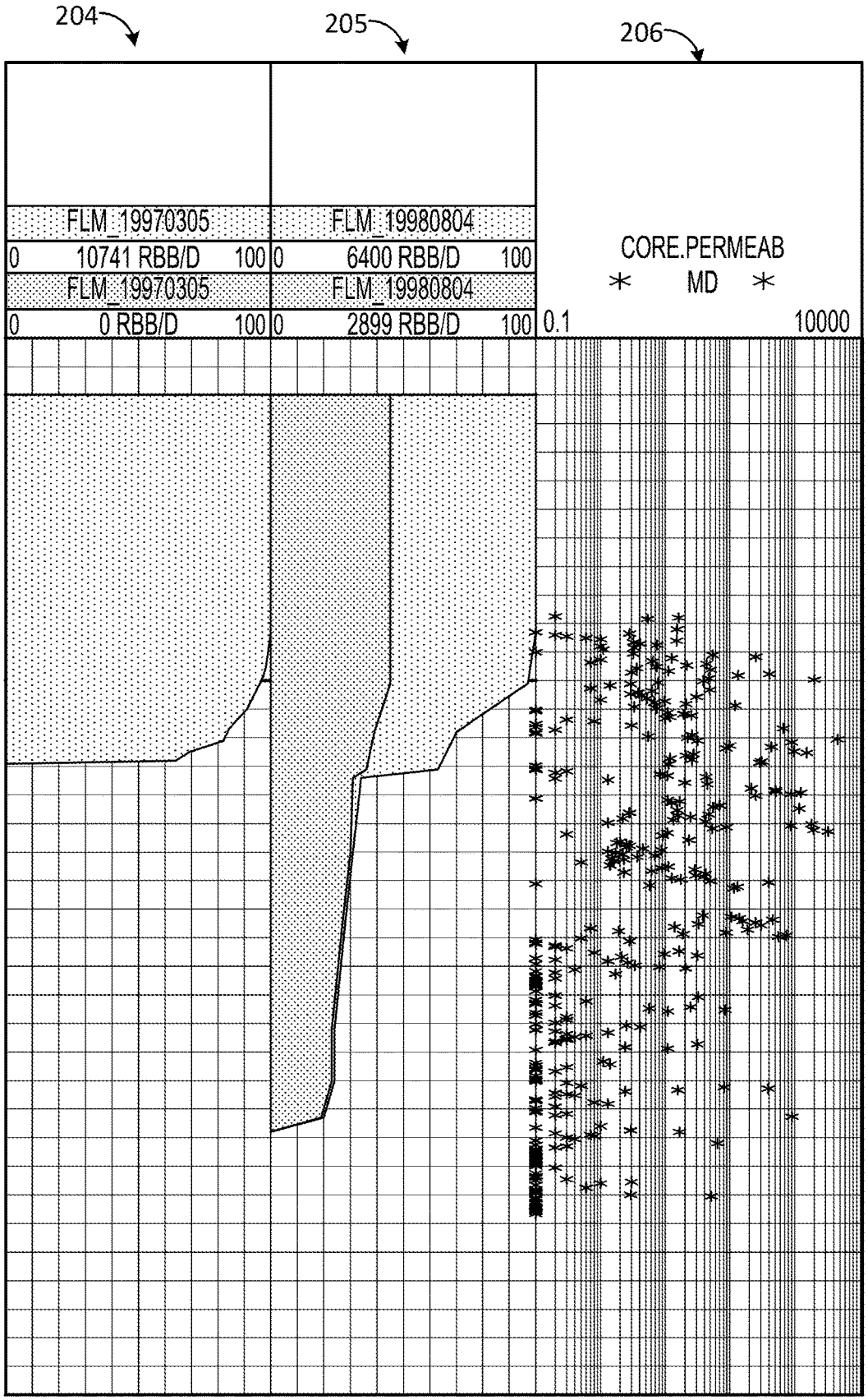

Hole size deviations can indicate productive zones with high-permeability in a reservoir. Referring to FIGS. 1 and 2, which respectively show flowmeter profile from a first well and a second well, high-permeability zones exists as calcite with dolomite lithotypes. Columns 101 and 201 respectively show the porosity data while columns 109 and 206 respectively show the permeability data. In the high-permeability dolomite zones, hole size deviations are evident for suspected intervals. However, washout is considered rare in these wells. The most common reason for hole enlargement is due to high-permeability dolomite occurrences. These productive zones with high-permeability zones are moderately unconsolidated rock formation subject to fracturing.

Flowmeter Log Evaluation

In more detail, column 102 of FIG. 1 shows results from the caliper log obtained for the first well. Because hole enlargement occurred through all depths, high-permeability zones became harder to distinguish. The strong variation in hole size for this well is likely due to high dolomite content in the formation. High dolomite content in the formation indicates a strong probability of high permeability zone occurrences. Hole enlargement started at a depth of 6,750 to 6,970 ft with an average diameter of approximately 7.5 in.

Column 202 of FIG. 2 shows the smooth caliper log measurement in terms of variation in hole size for the second well. A slight indication of hole enlargement occurs only at a depth of 6,580 ft. This well had less variation in hole size likely due to lower dolomite content in the formation compared to the first well. The depth of this zone is approximately 2 ft.

Columns 103 to 108 of FIG. 1 present flowmeter performance for the first well at different dates: 1978, 1982, 1984, 1987, 1989, and 1990. Here, the flowmeter profile includes measurements obtained in 1978, which was selected to evaluate the well performance. Notably, no water contributed to cumulative production. As illustrated, a high permeability zone at 6,765 ft contributed more than 80% of the production.

Columns 103 to 105 show the flow profile for the second well in 1996, 1997, and 1998. The production log, which was conducted in 1996, was selected to evaluate the well performance. As illustrated, more than 60% of oil production was obtained from a high permeability zone at a depth of 6,580 ft.

Permeability and Porosity Evaluation

Figure 4:
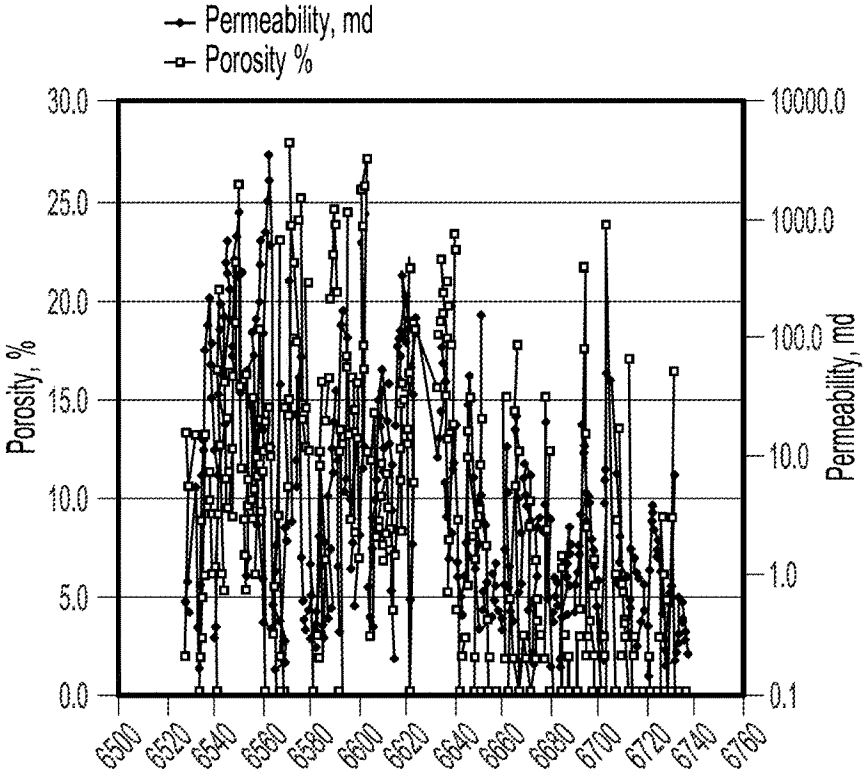
FIG. 4 shows the permeability and porosity as a function of depth inside the well of FIG. 2.
Figure 3:
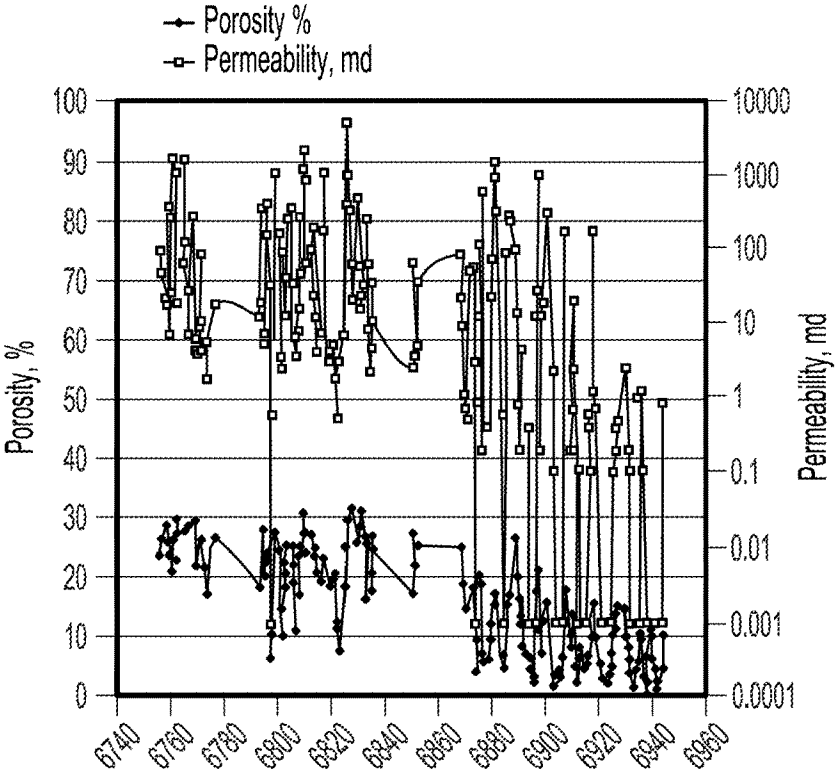
FIG. 3 shows the permeability and porosity as a function of depth inside the well of FIG. 1.

Permeability and porosity are significant factors for reservoir characterization. FIGS. 3 and 4 respectively show a reduction in permeability and porosity with depth for the first well and the second well. As illustrated in FIGS. 3 and 4, the productive zones with high permeability (located at 6,765 ft for the first well, and at 6,580 ft for the second well) had low porosity values. The main reason for difficulty in coring these zones was likely due to the extremely high permeability zone (fracture feature) or an unconsolidated rock formation.

Figure 5:
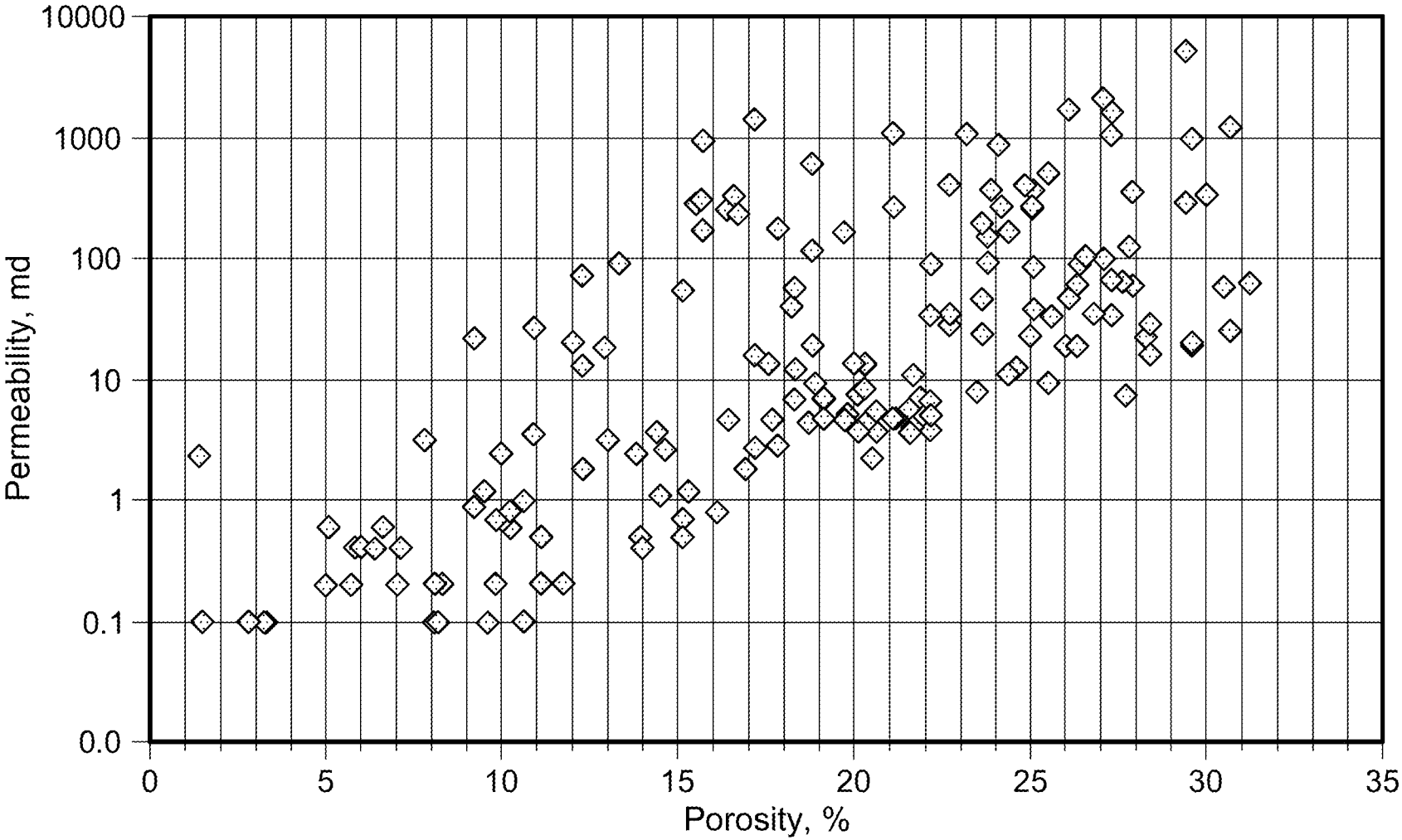
FIG. 5 shows the core porosity-permeability cross-plot for the well of FIG. 1.
Figure 6:
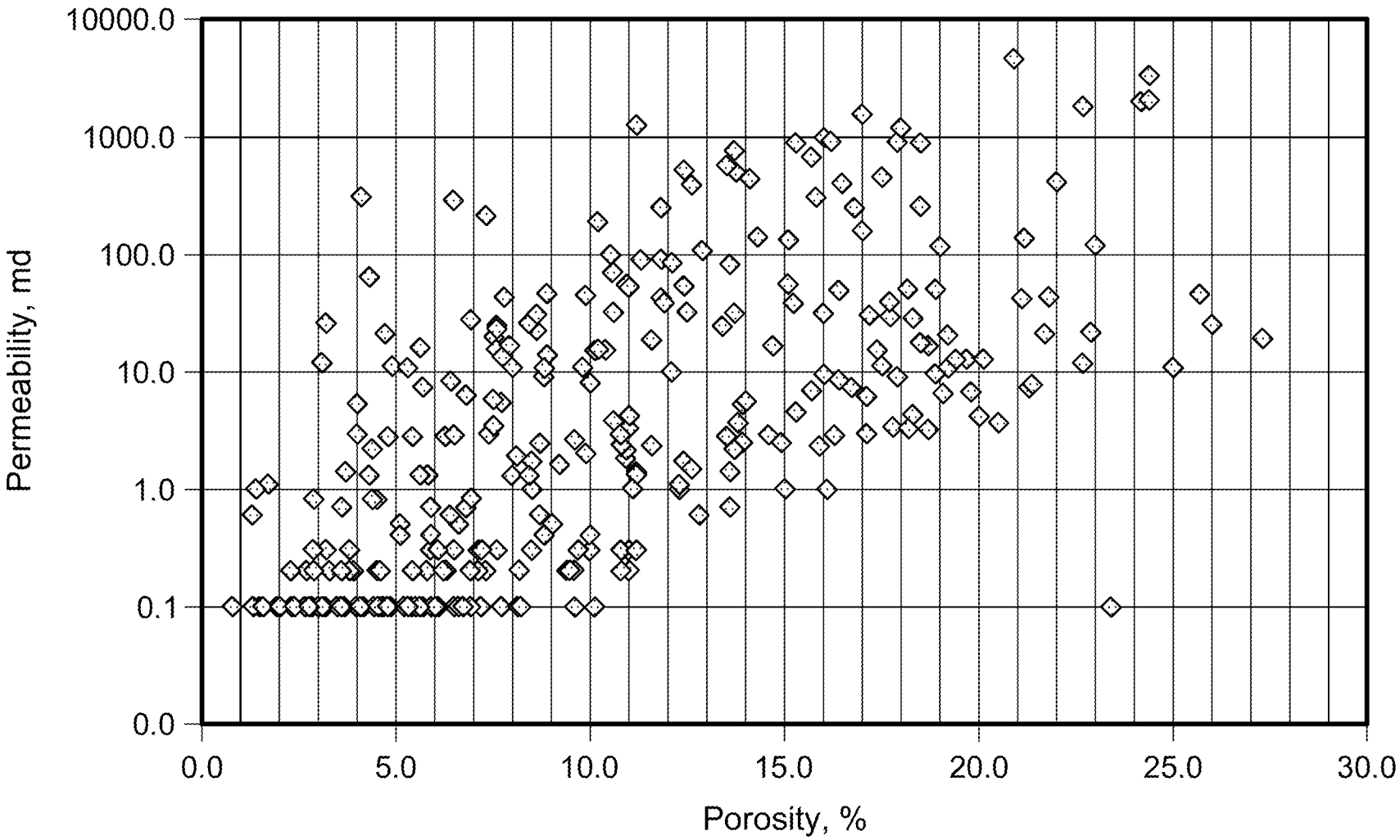
FIG. 6 shows the core porosity-permeability cross-plot for the well of FIG. 2.

FIGS. 5 and 6 respectively show the core porosity-permeability cross-plot for the first well and the second well. As illustrated, the lowest permeability value that could be obtained was 0.1 mD (millidarcy). Porosity varied from less than 3% to over 30%, while matrix permeability varied from 0.1 mD to over 1000 mD for the first well, as shown in FIG. 5, Finally, FIG. 6 shows that porosity varies from less than 2% to over 25%, while matrix permeability varied from less than 0.1 and to over 1000 and for the second well. However, for a given porosity, FIGS. 5 and 5 show samples with several magnitudes of permeability, and the highest permeability does not correspond to the highest porosity for both wells.

In general, FIGS. 5 and 6 indicate that the permeability and porosity are almost correlated. Permeability increased as porosity increased. However, there is no strong correlation between porosity and permeability for the first well and the second well. In other words, FIGS. 5 and 6 suggest that reservoir heterogeneity in the first well and the second well.

Amaefule's Method Evaluation

Some implementations may incorporate the use of Amaefule's approach to allow for a more quantitative definition of reservoir zonation. These implementations can provide an effective tool for carbonate reservoir characterization reservoir rock quality. In some implementations, Amaefule's method was used for identification of high permeability zones based on high quality values of RQI and FZI. The same two wells from the oil field case study, were used as subjects to demonstrate the application of this method.

Reservoir Quality Index (RQI) & Flow Zone Indicator (FZI)

Figure 7:
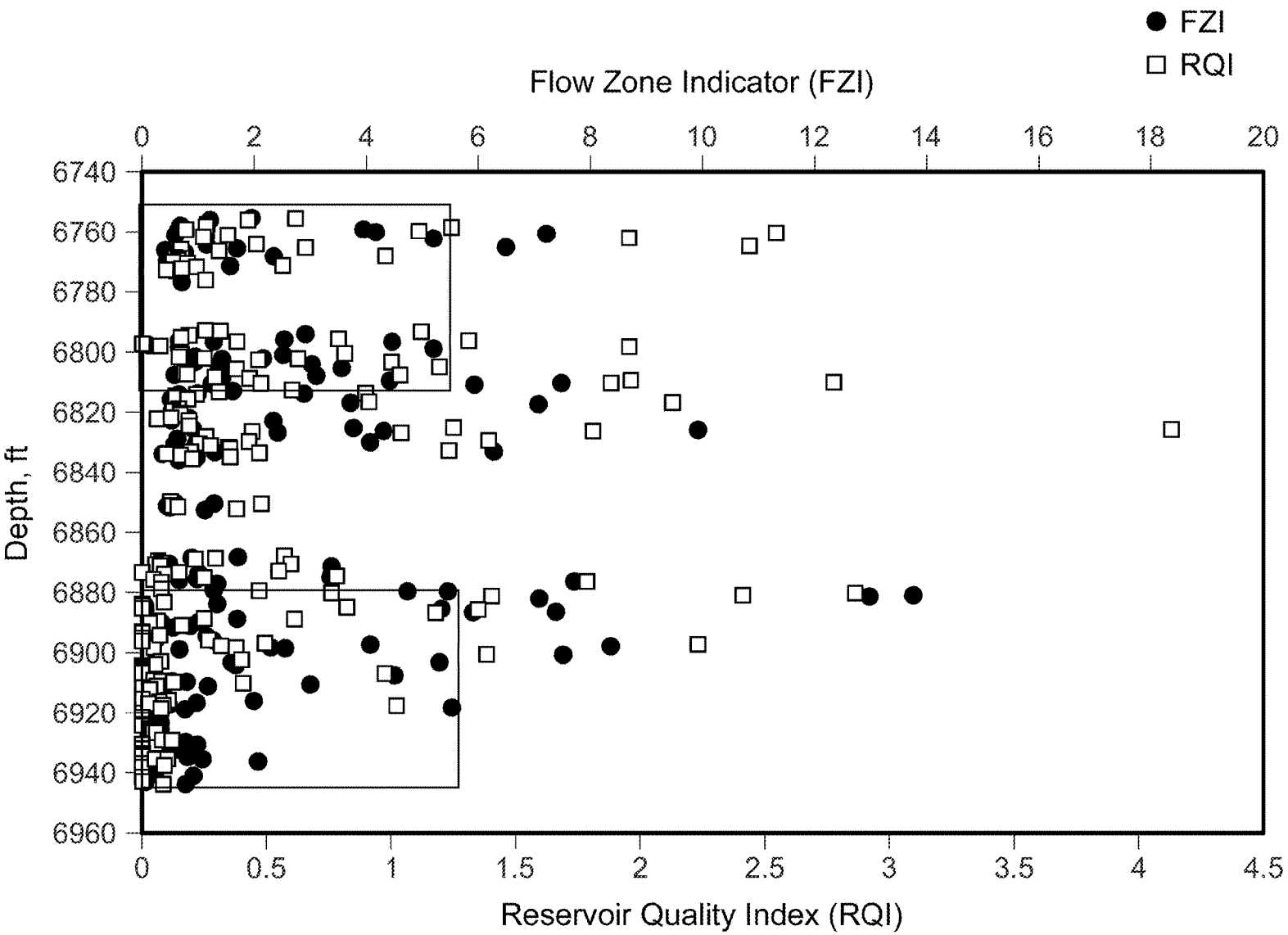
FIG. 7 shows the flow zone indicator (FZI) and reservoir quality index (RQI) for the well of FIG. 1.
Figure 8:
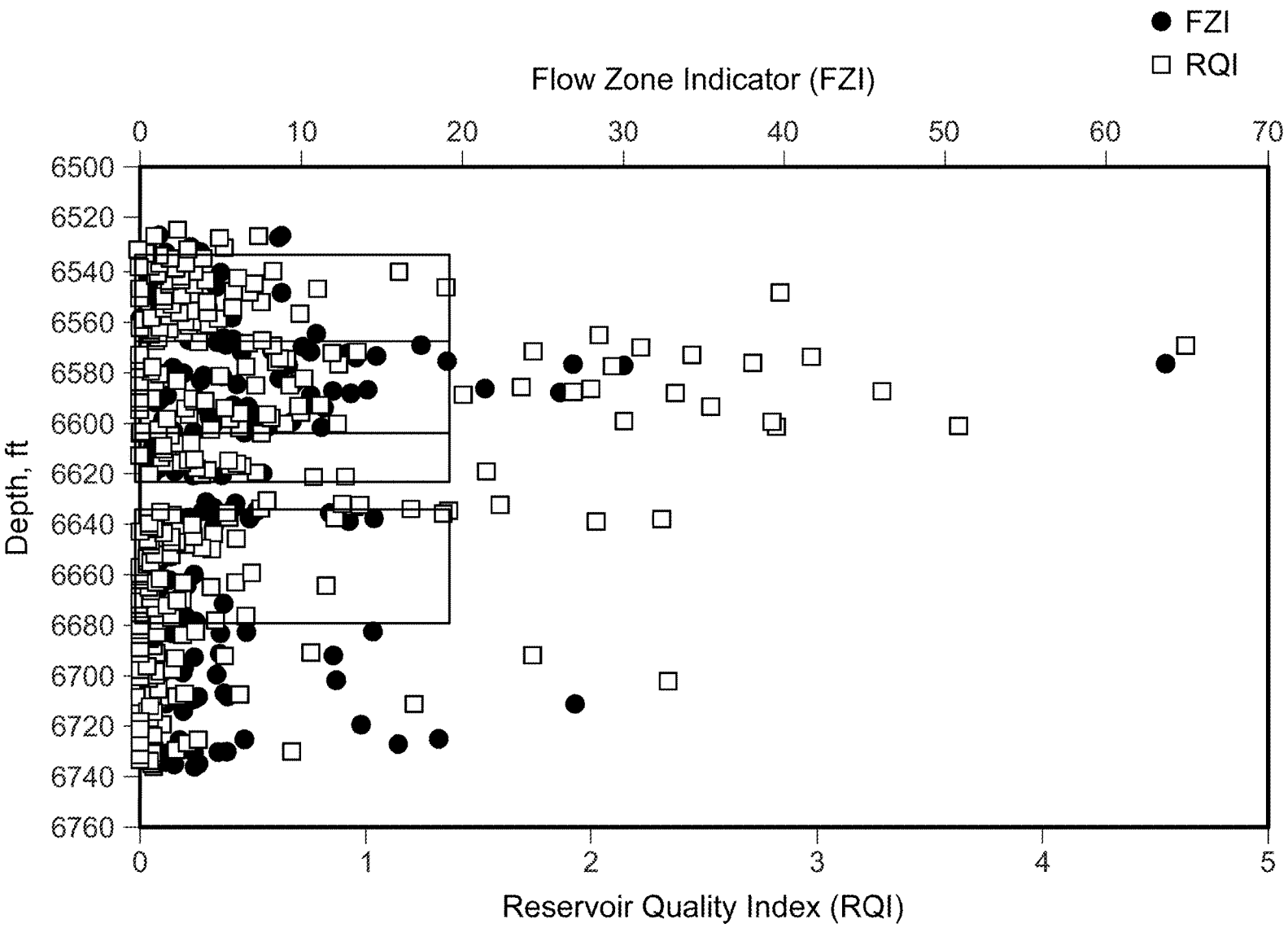
FIG. 8 shows the flow zone indicator (FZI) and reservoir quality index (RQI) for the well of FIG. 2.

Reservoir quality index can be defined as the square root of the ratio between permeability and porosity. This term (RQI) can be used to quantify the flow characteristics of a reservoir which can establish a relationship between petrophysical properties at micro-levels (core plug) and macro-levels (wellbore). FIGS. 7 and 8 show how RQI and FZI were selected for separating the reservoir of the two wells into different zone properties, based on high or low values of these measurements.

FIG. 7 shows FZI and RQI versus depth for the first well. FZI and RQI have been changed across the depth in terms of having either high or low values. The possibility of a productive zone (high permeability) at a depth of 6,770 ft was indicated, as well as other possible productive zones at 6,910 ft and 6,920 ft, respectively. The differentiation between flow zones, which contained productive zones or potential high permeability zones, was based on the high values of both RQI and FZI.

FIG. 8 shows high values of RQI and FZI for the second well at 6,580 ft where a productive zone may exist. High potential for productive zone at a depth of 6,640 ft was also indicated. The main reason for selecting the location of high potential permeability at a depth of 6,640 ft is that no core was obtained in this interval.

Figure 9:
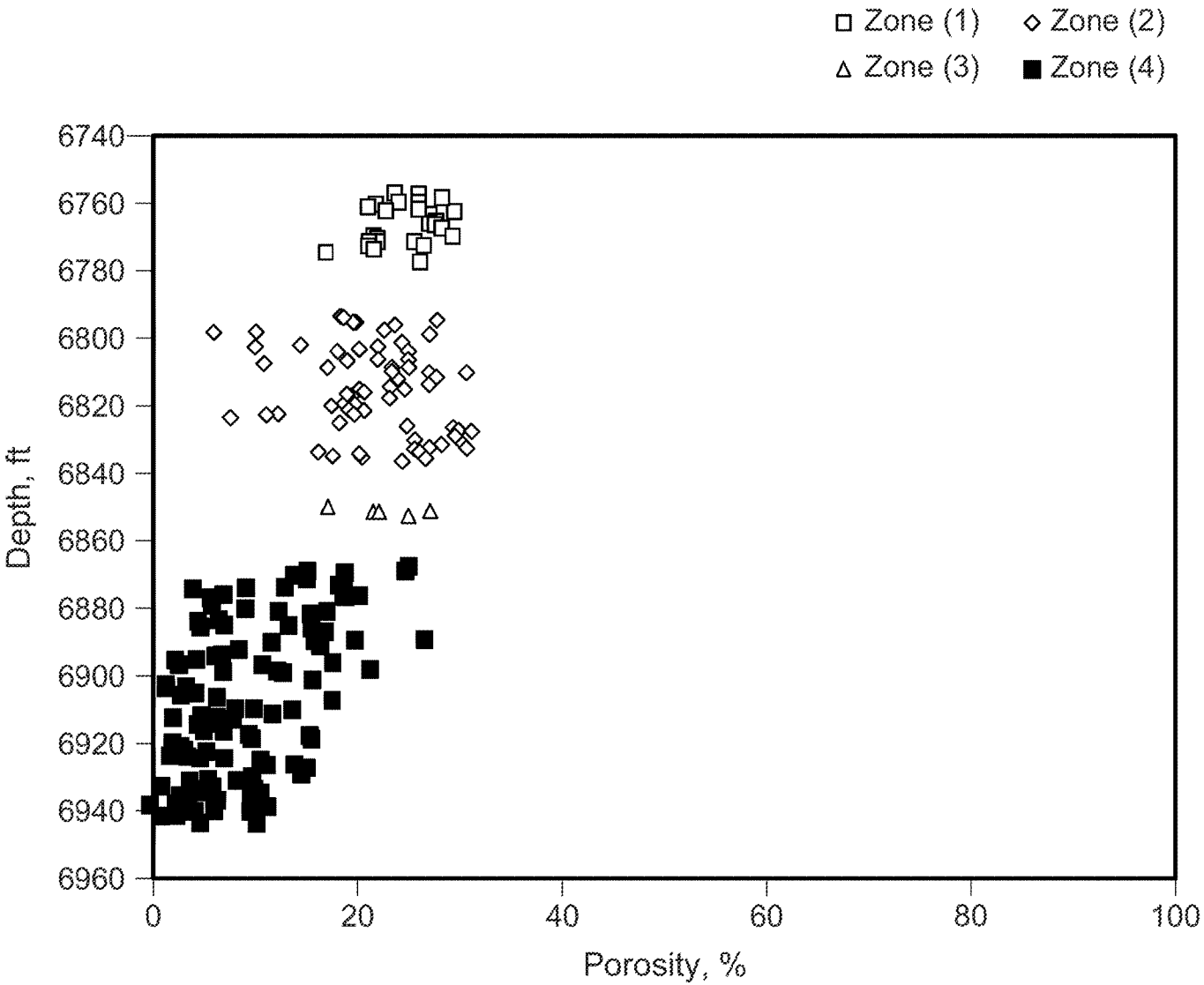
FIG. 9 shows the plot of porosity as a function of depth for the well of FIG. 1.
Figure 10:
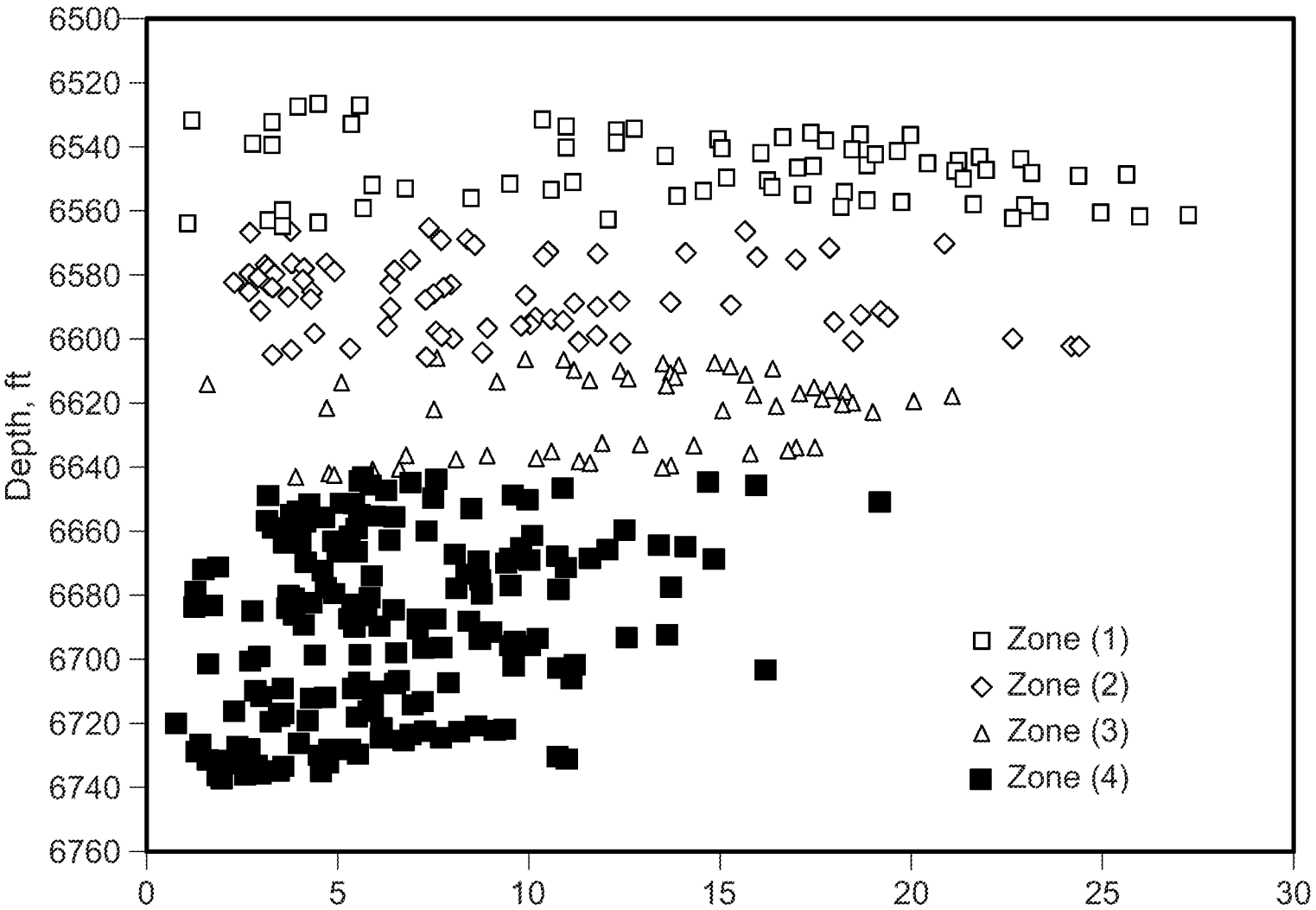
FIG. 10 shows the plot of porosity as a function of depth for the well of FIG. 2.

Porosity and permeability for each zone in the first and second wells was calculated to quantify both characteristics compared to the differentiation between flow zones for the entire depth. FIGS. 9 and 10 show the respective results from the first and second wells for porosity as a function of depth. These figures show that the productive zones had low porosity values within a thickness of 3 ft, which confirmed measurements obtained from the caliper log.

Figure 11:
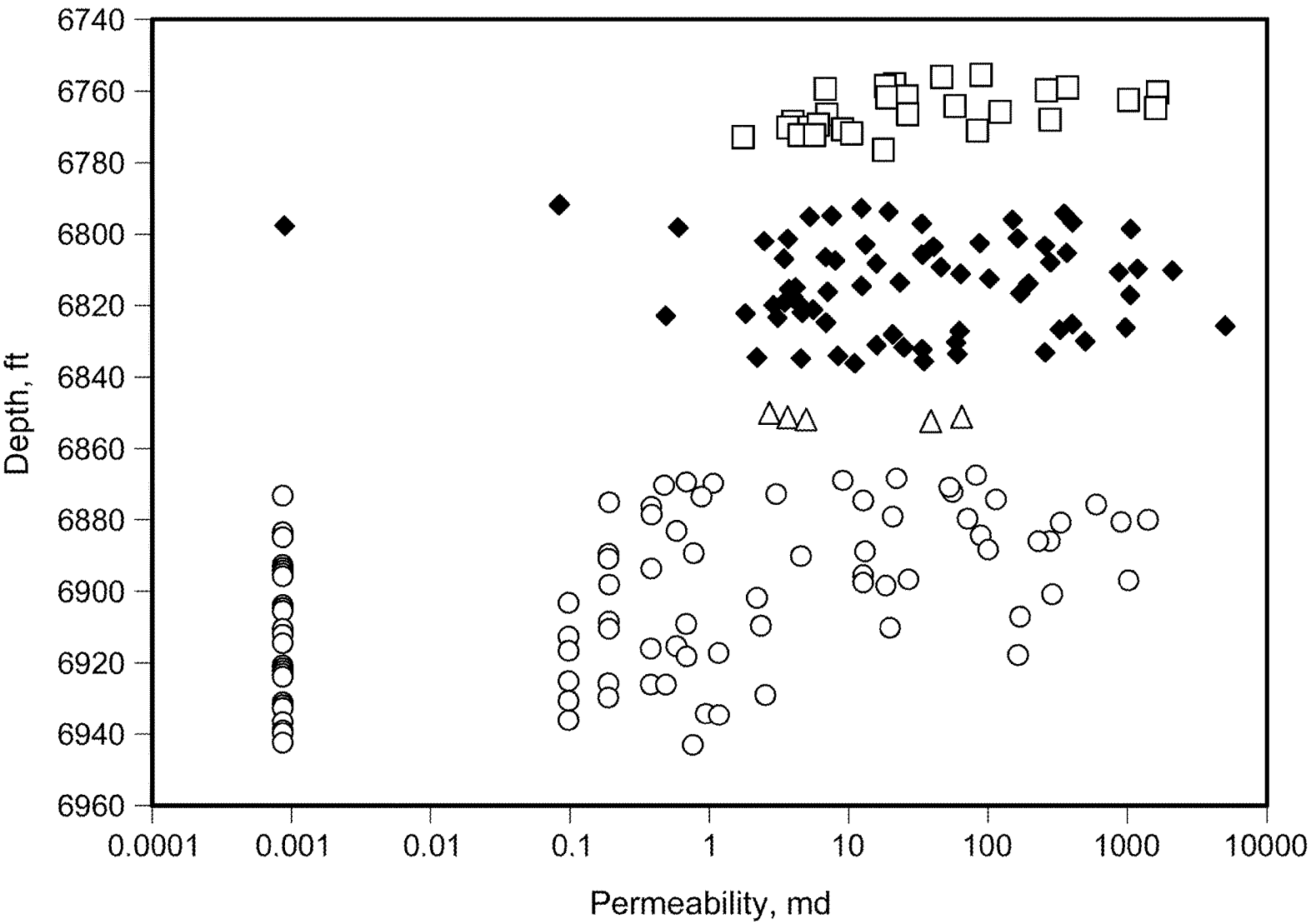
FIG. 11 shows the core permeability measurement versus depth for the well of FIG. 1.
Figure 12:
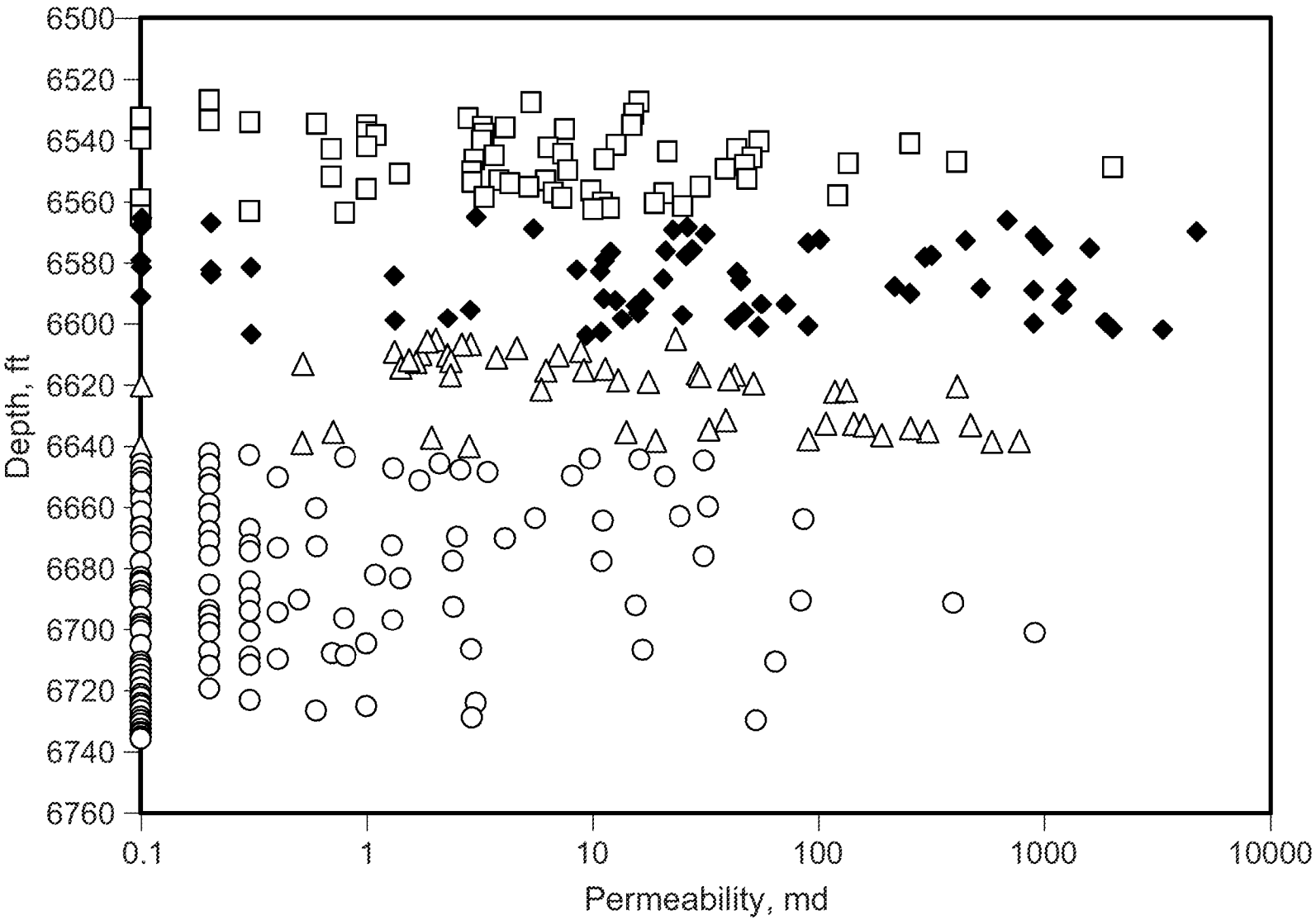
FIG. 12 shows the core permeability measurement versus depth for the well of FIG. 2.

FIGS. 11 and 12 show the respective results from the first and second wells for permeability versus depth. In particular, FIGS. 11 and 12 show the core permeability measurement versus depth for the two wells. In general, for both wells, the productive zones and high potential permeability zones at different depths and zone locations had high permeability. This observation is consistent with FZI and RQI for these wells, discussed previously.

Reservoir Heterogeneity Based on Flow Zone Indicator (FZI)

Flow zone indicator can be examined as a measurement of reservoir heterogeneity. Each distinct reservoir type has a rough FZI range of values based on different petrophysical types. A log-log plot of RQI versus NPI for Well A, and B are shown in FIGS. 13 and 14.

Figure 13:
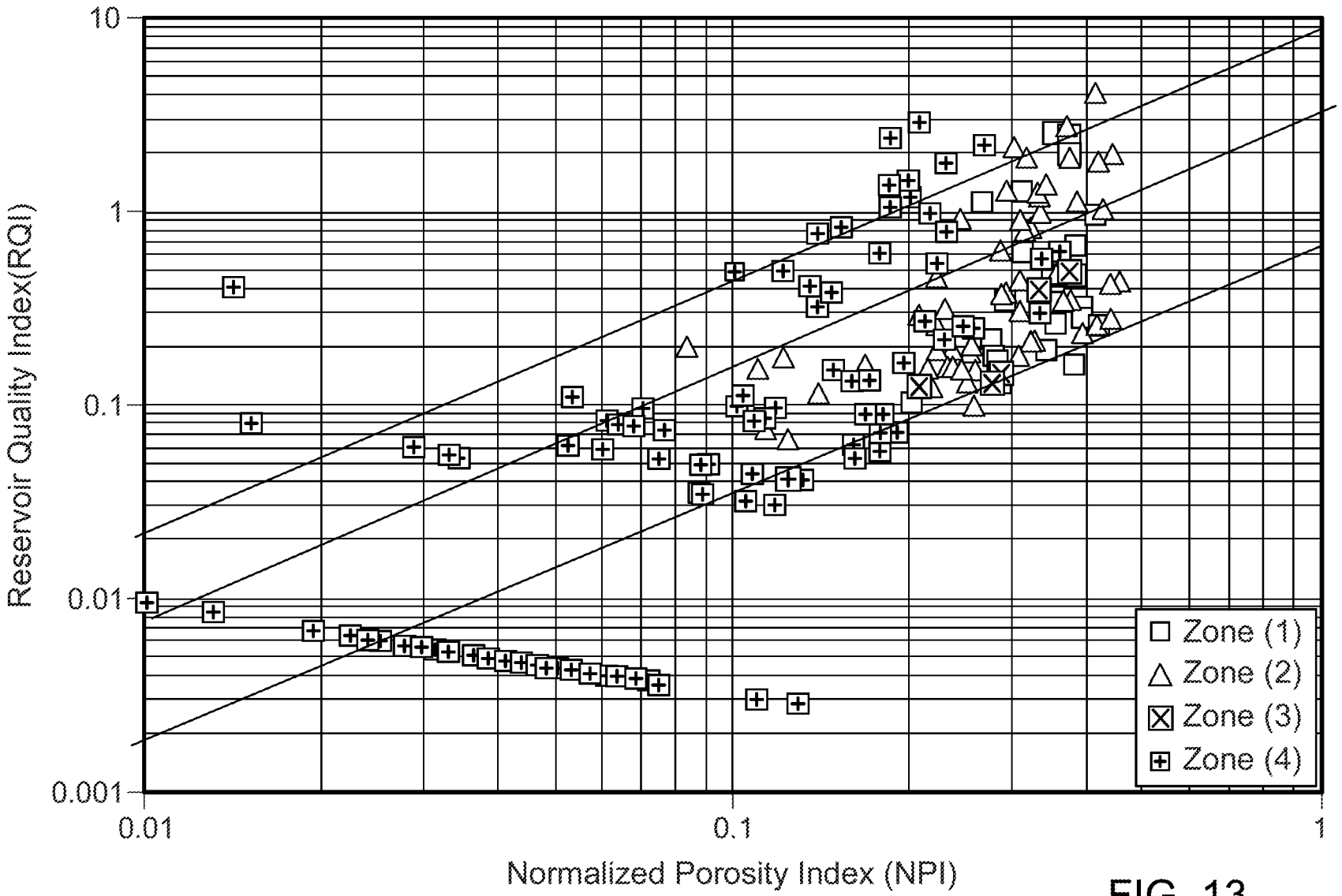
FIG. 13 shows a plot of RQI versus normalized porosity index (NPI) for the well of FIG. 1.

In particular, FIG. 13 shows a plot of RQI versus NFL for the first well. In this plot, samples with similar FZI values lie along a straight line for three values of FZI=8, 3, and 0.6. As illustrated, this well may have high reservoir heterogeneity.

Figure 14:
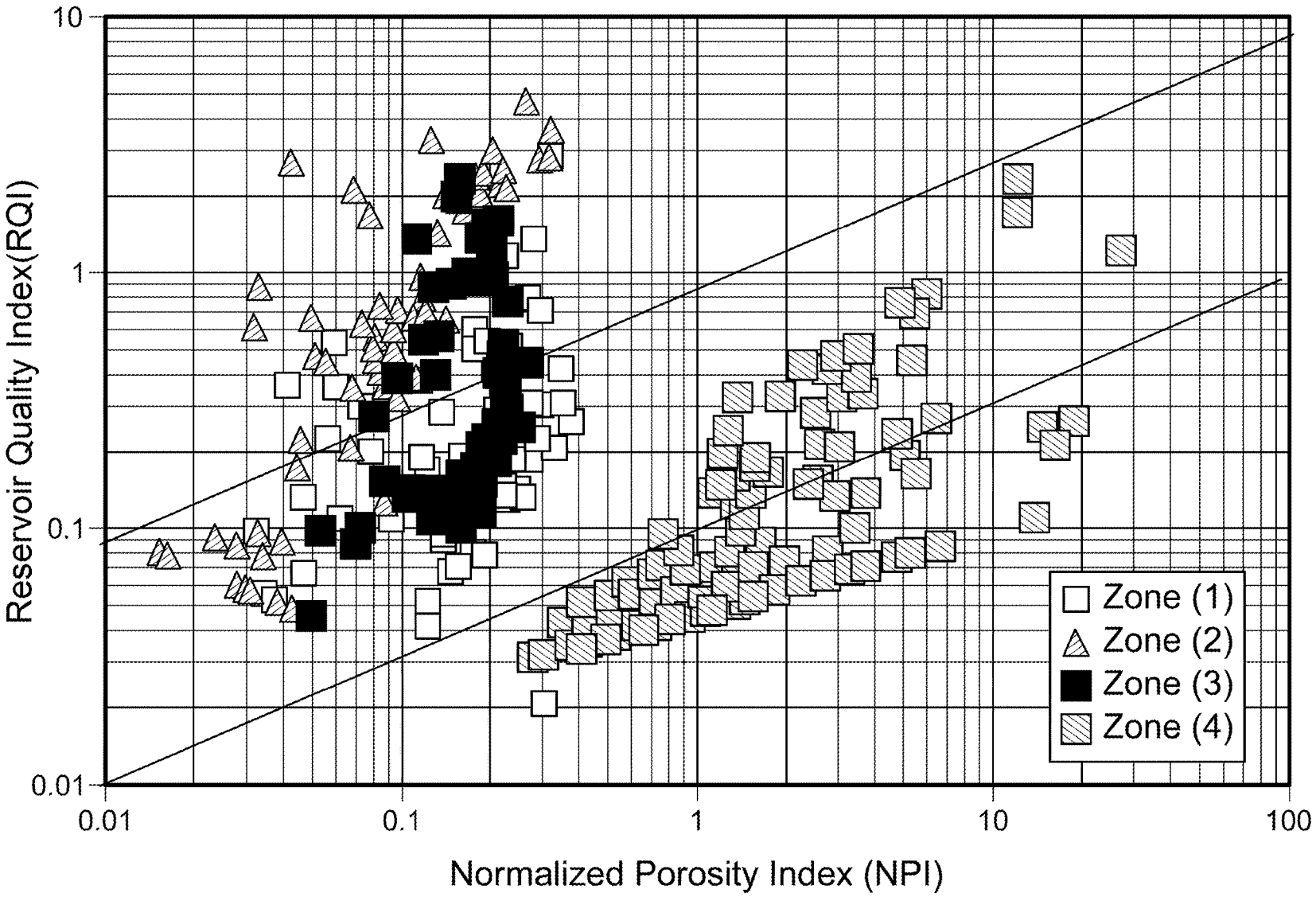
FIG. 14 shows a plot of RQI versus normalized porosity index (NPI) for the well of FIG. 2.

FIG. 14 illustrates the terms of RQI versus NPI in order to define FZI for Well B. As illustrated, the majority of samples with similar FZI are divided into two areas, which have FZI values of either 8 or 1. The reservoir heterogeneity for this second well appears to be less than that in the first well.

Flowmeter and Cumulative Reservoir Properties

Figure 15:
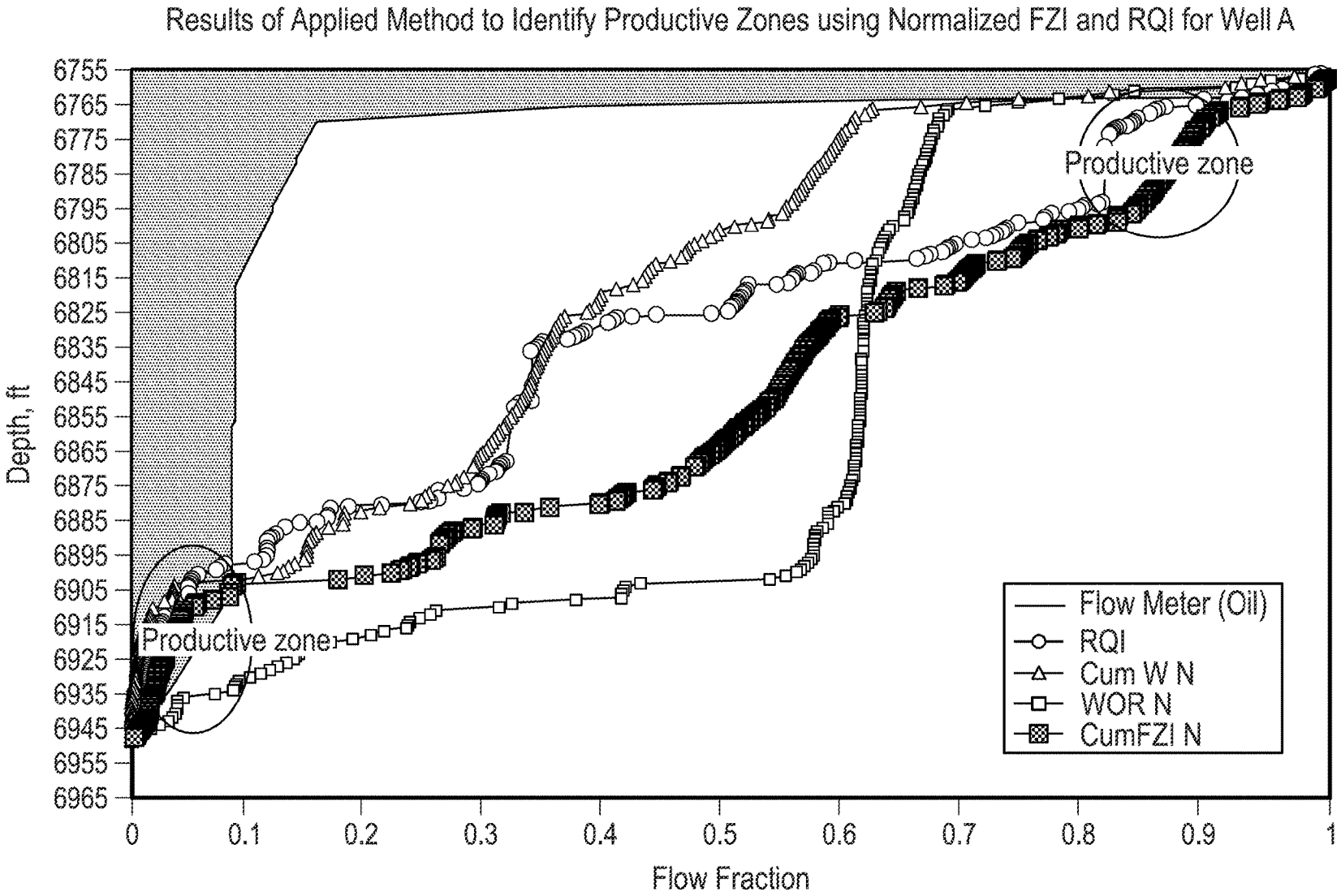
FIG. 15 shows examples of applying some implementations of the present disclosure to identify productive zones for the well of FIG. 1.

Flowmeter data were calibrated and normalized over the cored interval and plotted as fraction of flow from the base of the productive interval to the top. Assuming the total productivity of a well is a linear combination of individual flow zones, a normalization of permeability, RQI, and FZI starting at the bottom of the well may provide a convenient representation of variations with depth. A large fractional change in a cumulative property over a small depth represents large relative contributions of the property. In such a plot, consistent zones are characterized by straight lines with the slope of the line indicating the overall permeability, RQI, and FZI, with a particular depth interval. The lower the slope, the better the property, FIG. 15 shows the cumulative reservoir properties and flow meter performance versus depth for the first well. This plot shows that no match was obtained between flowmeter data and cumulative reservoir properties. However, cumulative reservoir properties curves can explain more details about reservoir behavior, especially the changes in slope through the depth. The limitations of the flowmeter turbine, which obtained the measurement for whole depth per foot, are known to production engineers. Still, the changes in slope for cumulative reservoir properties plots provide more insight about the flow zones, thereby rendering the slope a useful tool in formation evaluation. As illustrated in FIG. 15, the depth containing the most productive zones where located at a depth of 6,770 ft, 6,910 ft, and 6,920 ft compared to other zones with low reservoir quality from depth 6,770 ft to 6,900 ft.

When several fluids move through a porous medium, the flowrate of each fluid will governed by Darcy's Law as shown in equation 4, as shown below. The flowrate is influenced the fluid viscosity and flow potential pressure gradient, the cross-sectional area of porous medium and the permeability of porous medium. The hole radius can also be computed using equation 5. In one example, equations 4 and 5 were used to calculate the width and the effective hole radii, respectively for possible super-k zone at depth of 6,770 ft.

$$k_f w_f = \frac{q * \mu * \ln\left(\frac{r_e}{r_w}\right) * 141.2}{\Delta p}, \tag{4}$$

$$r_t = \left[\frac{q * 8 * \mu * L_t}{\Pi * \Delta p}\right]^{1/4} \tag{5}$$

The results suggest that the hole radii and width of this feature (super-k) are 2.45 cm and 1.78 cm, respectively. The permeability of this feature was defined as "matrix permeability" of productive zones using equation 5 and assuming that wf=3 ft, is 530 darcy.

Figure 16:
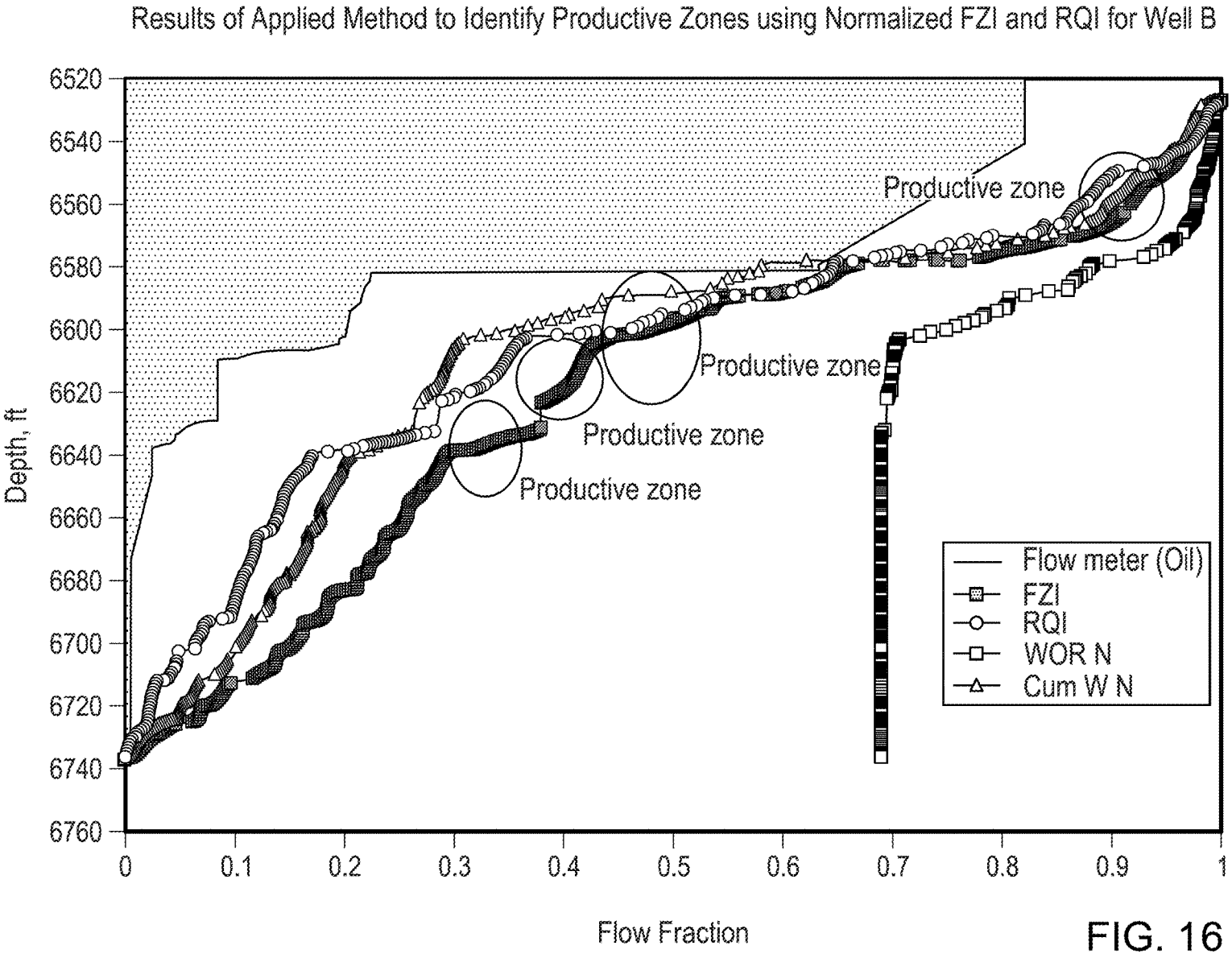
FIG. 16 shows examples of results when applying some implementations of the present disclosure to identify productive zones for the well of FIG. 2.

FIG. 16 shows an agreement in cumulative reservoir properties with flowmeter performance in terms of capturing high quality flow zones for whole depth in the second well. Depths of 6,640 ft had high slope on plots of cumulative reservoir properties, which indicated the high reservoir quality. This Observation was matched by the flowmeter performance in terms of high productive zones. Another observation that can be obtained from this figure is that depths below than 6,640 ft had low reservoir quality or fractures features. In addition, Equations 4 and 5 were also used to calculate width and the effective hole radii for possible productive zones at depths of 6580 ft and 6,640 ft. The results are suggested that the hole radii and width of this feature productive zones at depth of 6,580 are 0.8 cm and 0.399 cm, respectively and at depth of 6,640 ft are 0.718 cm and 0.429 cm, respectively. Furthermore, the permeabilities of productive zone with width of 3 ft at depth of 6,580 ft and 6,640 ft are 6 darcy and 4 darcy, respectively.

Water-Oil Ratio (WOR) and its Derivative WOR' Curves Evaluation

Some implementations incorporate the comparison results between analytical semi steady state curves of Water-Oil-Ratio (WOR) and its time derivative (WOR') with respect to time and a diagnostic base on core analysis and flowmeter profile type curve. The characterization of productive zones from reservoir point of view by analytical methods can be very useful when combined with a diagnostic base from porosity, permeability, RQI and FZI, which are obtained from a modified Carman-Kozeny method proposed by Amaefule to identify productive zones with high permeability.

Some implementations relate characterization of productive zones with high permeability by using historical analysis charts in semi-steady states regime which analyze the Water-Oil Ratio (WOR) and its derivative WOR'(dWOR/dt) versus a depth as one aspect with a combination of flowmeter profile, the cumulative distribution of permeability, porosity, RQI, FZI. These implementations can be used for characterization of productive zones with flow path (geometry) in reservoirs by describing features of flow such as radial and/or linear type of regimes. These flow features can be a combination of more complex condition linked to near wellbore and oil production in multilayer reservoirs. The implementations may offer a qualitative analysis of water-oil ratio (WOR) performance data and its derivative WOR' (dWOR/dt) combined with a combination of flowmeter profile, the cumulative distribution of permeability, porosity, RQI, FZI in terms of monitoring changes in wellbore conditions, reservoir properties as well as characterization of boundary conditions to have better well evaluation with the best diagnosis of oil source.

Figure 17:
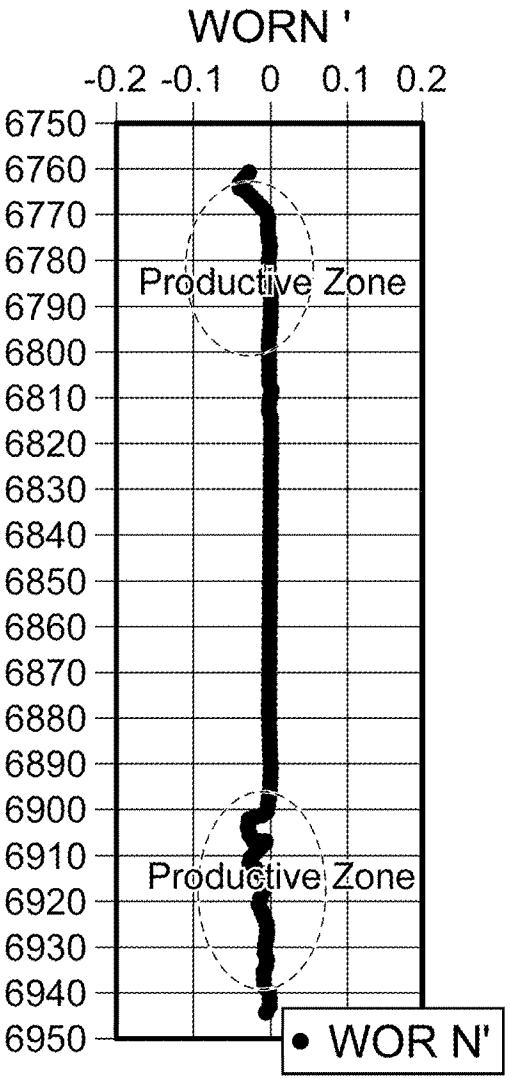
FIG. 17 shows examples of results when applying some implementations of the present disclosure to identify productive zones for the well of FIG. 1.
Figure 17:
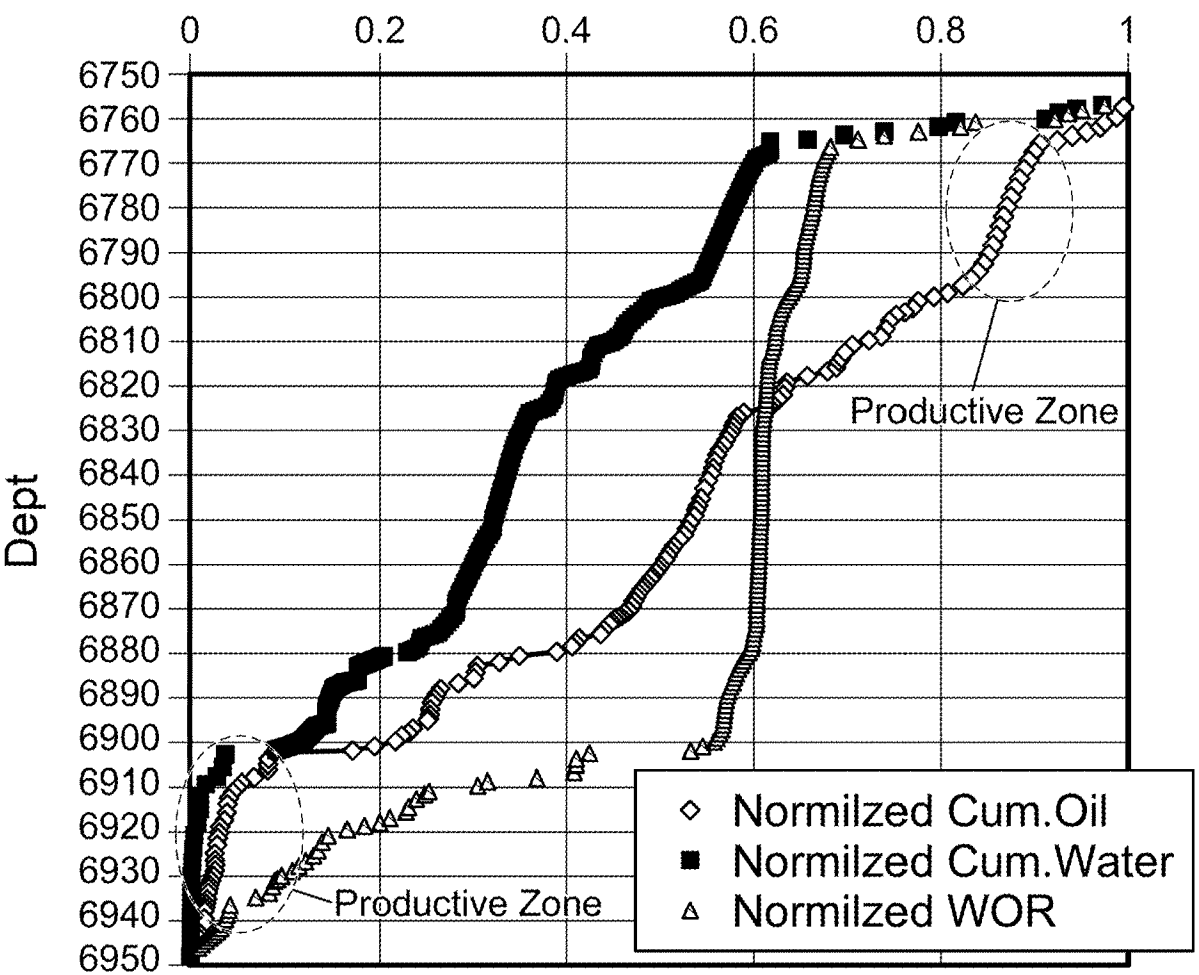

FIG. 17 shows the cumulative production profile from flow meter performance combined with Water-Oil Ratio (WOR') derivative versus depth for the first well. This plot shows that a negative change with WOR' derivate was indicated across the productive zones with an agreement on a trend of cumulative normalized oil, and water profile. However, cumulative normalized Water-Oil Ratio derivative curve can shed more light on reservoir behavior, especially the changes in slope through the depth. The limitations of the flowmeter turbine, which obtained the measurement for whole depth per foot, are known to production engineers. Still, the changes in slope for cumulative normalized Water-Oil Ratio (WOR') derivative curve provide additional insight about the flow zones and reservoir quality, and hence can be used as useful tool in formation evaluation to capture productive zones across the reservoir intervals.

FIG. 17 shows that the depth containing the productive and/or high potential reservoir permeability had a negative value on cumulative normalized Water-Oil Ratio derivative curve at a depth of 6,760 ft and 6,905 ft compared to other zones from depth 6,820 ft and below. Another observation that can be obtained from FIG. 17 is that depths below than 6,820 ft had less reservoir quality with low productive zones or low reservoir permeability as no change observed on cumulative normalized Water-Oil Ratio derivative curve as agreed with a trend of cumulative reservoir properties with flowmeter performance in terms of capturing high quality flow zones for whole depth in Well A as shown in FIG. 15.

Figure 18:
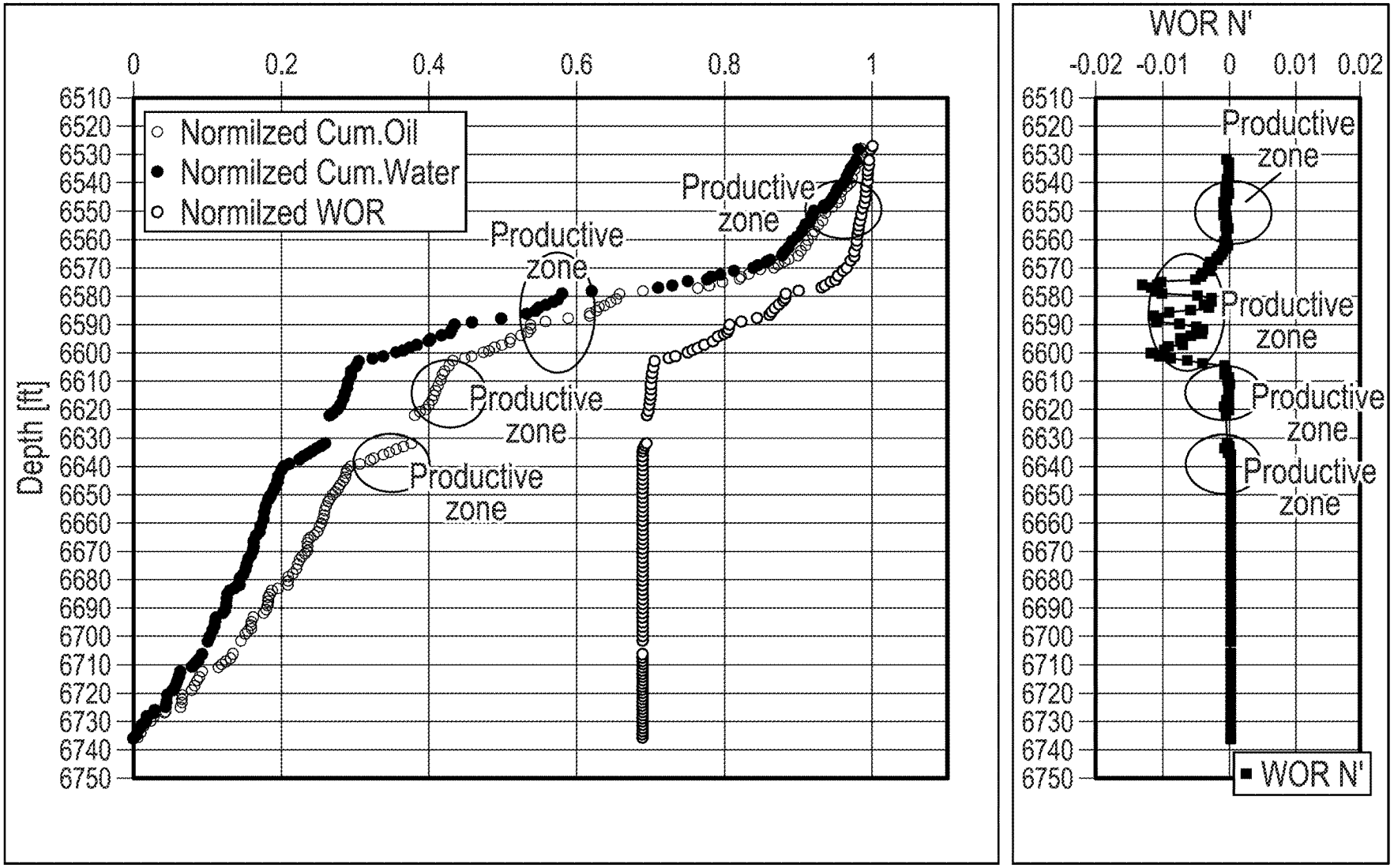
FIG. 18 shows examples of results when applying some implementations of the present disclosure to identify productive zones for the well of FIG. 2.

FIG. 18 shows an agreement in cumulative production profile in terms of normalized WOR', oil, and water trend with flowmeter performance in terms of capturing high quality flow zones for whole depth in the second well. As illustrated, depths from 6,570 ft to 6,600 ft had negative values on plots of cumulative normalized Water-Oil Ratio (WOR') derivative curve, which indicated the productive zones with high reservoir quality. This observation was matched by the cumulative flowmeter performance trend in terms of productive zones and high permeability reservoir intervals as shown in FIG. 16. Another observation that can be obtained from this figure is that depths below 6,640 ft had reservoir quality with productive zones or high reservoir permeability as no change was observed on cumulative normalized Water-Oil Ratio derivative curve, which is consistent with cumulative reservoir properties with flowmeter performance in terms of capturing high quality flow zones for whole depth in the second well as shown in FIG. 16.

Implementations may utilize petrophysical and logging analysis for improved reservoir characterization, and can reduce the well logging activities during the exploration and production stages. The implementations provide unique and first time methodology to identify and to confirm productive zones with high-permeability carbonate intervals for oil wells. The new methodology can yield improved reservoir characteristic to identify productive zones utilizing a multivariate relation for a behavior of core analysis, flowmeter and Water-Oil-Ratio (WOR) and derivative of WOR (WOR') curves combined. The implementations can capture fractures/faults or other high permeability streak zones in direct contact with oil production wells. The implementations can provide reservoir quality and interval contribution of oil production across the reservoir as well as to the wellbore. The implementations can provide a synergic approach by providing and illustrating a mechanism on existed features such as multi-layers, fractures, faults, and super-K zones as well as to have better understanding features types related to productive zones and its contribution in terms of production profile across the pay zones. The implementations can integrate at sufficiently large and small level of data measurements in terms of core analysis and production profile with correlations to reflect the reservoir quality and interval contribution across the reservoirs as well as to the wellbore.

Implementations may achieve characterization of productive zones with high-permeability using conventional and unconventional petrophysical tests in conjunction with flowmeter measurements and a derivative of WOR (WOR') from production profile. Implementations can provide a fundamental identification by conducting a thorough synergistic and relationship-revealing approach of formation evaluation at the core scale, using special core analyses of multidirectional porosity and permeability, and a derivative of WOR (WOR') from production profile in oil wells at wellbore scale, using on open-hole flowmeter results. Integration of the cumulative distribution of reservoir quality index (RQI), and flow zone indicator (FZI) can be carried out to differentiate between zones in terms of location and properties. Additionally, open-hole flowmeter data with derivative of WOR (WOR') can be used to capture pay zones (Productive intervals) with high-permeability and/or fractures features, even in the heterogeneous carbonate reservoirs. Implementations can include a combination of WOR' and cumulative distribution of reservoir quality index (ROI), and flow zone indicator (FZI) to differentiate between zones in terms of location and properties. The combination can function as an effective tool for improved characterization of the reservoir behavior, thereby capturing productive zones. The implementations can perform integrated conventional and unconventional petrophysical tests with production profile especially WOR trend to achieve a consistent interpretation of different features' behavior in a heterogonous reservoir and to identify productive zones. Finally, the results can guide design a successful conformance treatment in oil wells.

In particular, implementations can include the comparison results between analytical semi steady state curves of water-oil-ratio (WOR) and its time derivative (WOR') with respect to time and a diagnostic comparison with cumulative distribution of reservoir quality index (ROI), and flow zone indicator (HI) to differentiate between zones in terms of location and properties. The characterization of oil reservoir for improved interval identification in terms of reservoir quality rock type can be very useful when combined with a diagnostic base on conventional and unconventional petrophysical tests in conjunction with flowmeter measurements and a derivative of WOR (WOR') from production profile.

In sum, implementations can lead to tremendous realization in term of identifying productive zones across oil bearing reservoir to facilitate successfully drilled wells, thereby reducing the cost of exploration process. The implementations can also facilitate selecting target zones prior to completion of perforation. In addition, implementations can provide cost effective analysis in terms hydrocarbon pay zone identification related to oil reservoir in oil wells.

Figure 19:
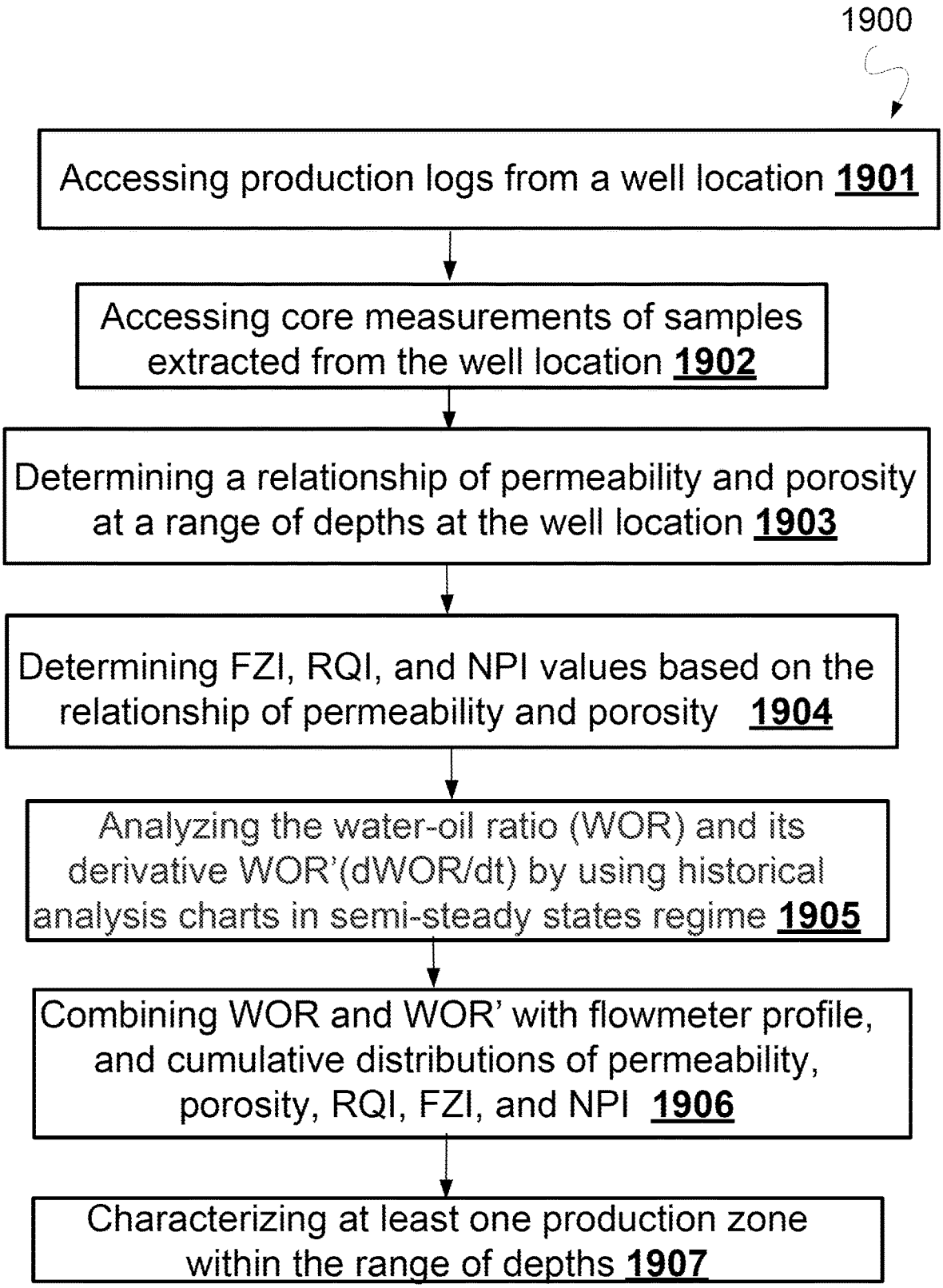
FIG. 19 is a flow chart illustrating an example of a process according to some implementations of the present disclosure.

As illustrated by the flow chart 1900 of FIG. 19, an implementation may start with obtaining access to production logs of a carbonate reservoir (1901). The production logs may include data encoding a flow meter profile and a ratio of water and oil (WOR) at each depth of a range of depths. The flow meter profile may be represented as a percentage of total flow with the range of depths.

The implementation may then obtain access to core measurements of samples extracted from each depth within the range of depths (1902). These core measurements may include, for example, caliper measurements. Based on the measurements of core samples, the implementation may determine a relationship of permeability and porosity at each depth within the range of depths at the well location (1903). For example, the implementation may determine a distribution of reservoir quality index (RQI), and a distribution of normalized porosity index (NFL) based on the relationship of permeability and porosity at each depth within the range of depths (1904). The implementation may then determine a distribution of flow zone indicator (FZI) based on the distribution of RQI and the distribution of NPI at each depth within the range of depths (1904). The combination may further include the distribution of RQI, the distribution of NPI, and the distribution of FZI.

Based on the production logs, the implementations may analyze the WOR to determine a derivative WOR' (dWOR/dt) at each depth within the range of depths. For example, the implementation may analyze the water-oil ratio (WOR) and its derivative WOR'(dWOR/dt) by using historical analysis charts in semi-steady states regime (1905).

The implementation may characterize at least one productive zone at the well location based on a combination of the WOR, the WOR', the flow meter profile, and the relationship of permeability and porosity at each depth within the range of depths (1907). For example, the implementation may combine WOR and WOR' with flowmeter profile, and cumulative distributions of permeability, porosity, RQI, FZI, and NPI (1906).

The implementation may feed the characterization of the at least one productive zone to an operator managing the carbonate reservoir. This feed may be provided on a display device of a computer system. In some cases, the implementation may establish a database of productive zones characterized based on the combination of the WOR, the WOR', the flow meter profile, and the relationship of permeability and porosity at each depth within the range of depths. In these cases, the implementation may correlate the database of productive zones with actual production logs; refine the combination of the WOR, the WOR', the flow meter profile, and the relationship of permeability and porosity based on correlation results; and characterize at least one productive zone at the well location based on the refined combination.

Figure 20:
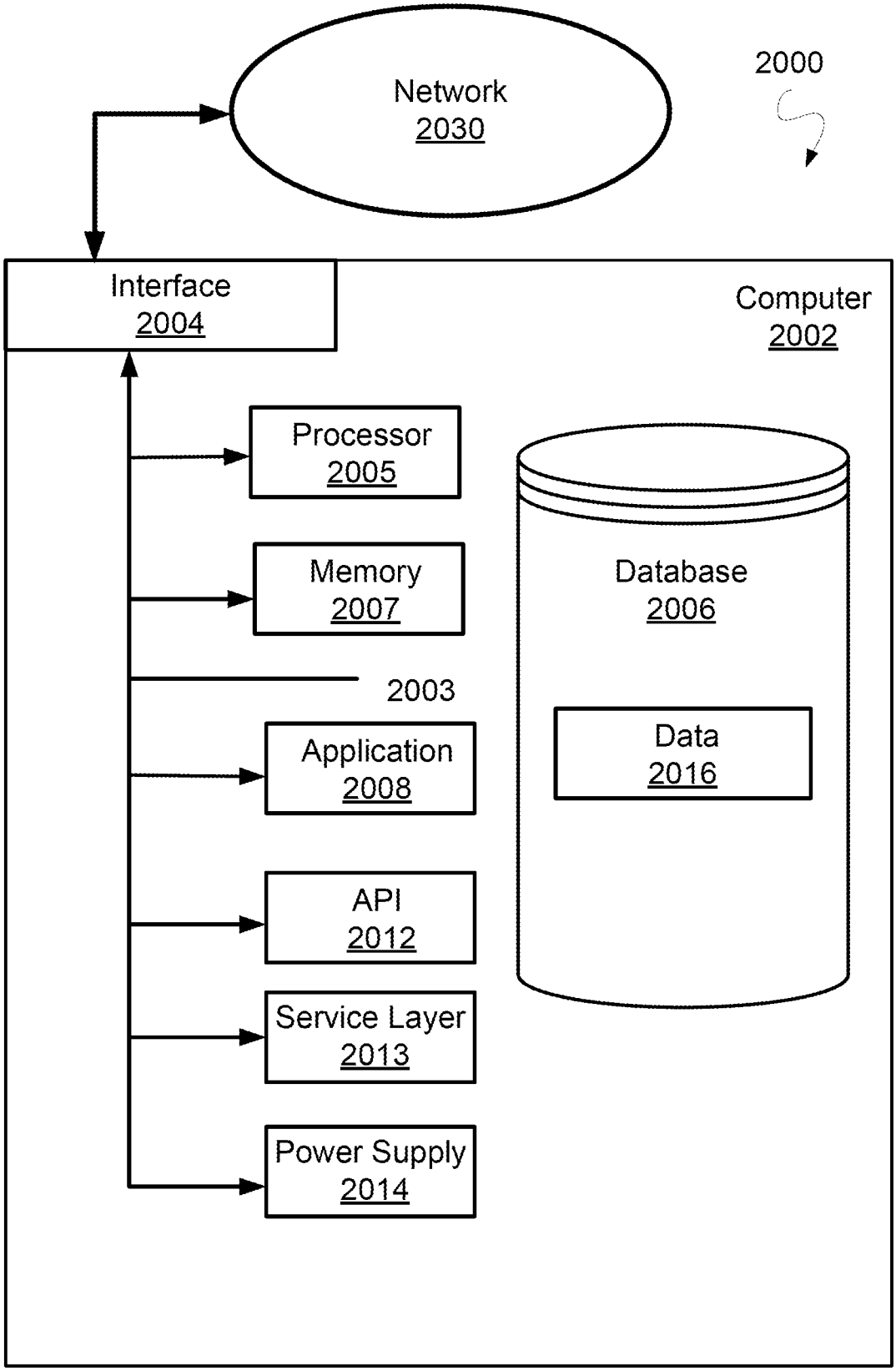
FIG. 20 is a block diagram illustrating an example of a computer system used to provide computational functionalities associated with described algorithms, methods, functions, processes, flows, and procedures, according to an implementation of the present disclosure.

FIG. 20 is a block diagram illustrating an example of a computer system 2000 used to provide computational functionalities associated with described algorithms, methods, functions, processes, flows, and procedures, according to an implementation of the present disclosure. The illustrated computer 2002 is intended to encompass any computing device such as a server, desktop computer, laptop/notebook computer, wireless data port, smart phone, personal data assistant (PDA), tablet computing device, one or more processors within these devices, another computing device, or a combination of computing devices, including physical or virtual instances of the computing device, or a combination of physical or virtual instances of the computing device. Additionally, the computer 2002 can comprise a computer that includes an input device, such as a keypad, keyboard, touch screen, another input device, or a combination of input devices that can accept user information, and an output device that conveys information associated with the operation of the computer 2002, including digital data, visual, audio, another type of information, or a combination of types of information, on a graphical-type user interface (UI) (or GUI) or other UI.

The computer 2002 can serve in a role in a computer system as a client, network component, a server, a database or another persistency, another role, or a combination of roles for performing the subject matter described in the present disclosure. The illustrated computer 2002 is communicably coupled with a network 2003. In some implementations, one or more components of the computer 2002 can be configured to operate within an environment, including cloud-computing-based, local, global, another environment, or a combination of environments.

The computer 2002 is an electronic computing device operable to receive, transmit, process, store, or manage data and information associated with the described subject matter. According to some implementations, the computer 2002 can also include or be communicably coupled with a server, including an application server, e-mail server, web server, caching server, streaming data server, another server, or a combination of servers.

The computer 2002 can receive requests over network 2003 (for example, from a client software application executing on another computer 2002) and respond to the received requests by processing the received requests using a software application or a combination of software applications. In addition, requests can also be sent to the computer 2002 from internal users, external or third-parties, or other entities, individuals, systems, or computers.

Each of the components of the computer 2002 can communicate using a system bus 2003. In some implementations, any or all of the components of the computer 2002, including hardware, software, or a combination of hardware and software, can interface over the system bus 2003 using an application programming interface (API) 2012, a service layer 2013, or a combination of the API 2012 and service layer 2013. The API 2012 can include specifications for routines, data structures, and object classes. The API 2012 can be either computer-language independent or dependent and refer to a complete interface, a single function, or even a set of APIs. The service layer 2013 provides software services to the computer 2002 or other components (whether illustrated or not) that are communicably coupled to the computer 2002. The functionality of the computer 2002 can be accessible for all service consumers using this service layer. Software services, such as those provided by the service layer 2013, provide reusable, defined functionalities through a defined interface. For example, the interface can be software written in JAVA, C++, another computing language, or a combination of computing languages providing data in extensible markup language (XML) format, another format, or a combination of formats. While illustrated as an integrated component of the computer 2002, alternative implementations can illustrate the API 2012 or the service layer 2013 as stand-alone components in relation to other components of the computer 2002 or other components (whether illustrated or not) that are communicably coupled to the computer 2002. Moreover, any or all parts of the API 2012 or the service layer 2013 can be implemented as a child or a sub-module of another software module, enterprise application, or hardware module without departing from the scope of the present disclosure.

The computer 2002 includes an interface 2004. Although illustrated as a single interface 2004 in FIG. 20, two or more interfaces 2004 can be used according to particular needs, desires, or particular implementations of the computer 2002. The interface 2004 is used by the computer 2002 for communicating with another computing system (whether illustrated or not) that is communicatively linked to the network 2003 in a distributed environment. Generally, the interface 2004 is operable to communicate with the network 2003 and comprises logic encoded in software, hardware, or a combination of software and hardware. More specifically, the interface 2004 can comprise software supporting one or more communication protocols associated with communications such that the network 2003 or interface's hardware is operable to communicate physical signals within and outside of the illustrated computer 2002.

The computer 2002 includes a processor 2005. Although illustrated as a single processor 2005 in FIG. 20, two or more processors can be used according to particular needs, desires, or particular implementations of the computer 2002. Generally, the processor 2005 executes instructions and manipulates data to perform the operations of the computer 2002 and any algorithms, methods, functions, processes, flows, and procedures as described in the present disclosure.

The computer 2002 also includes a database 2006 that can hold data for the computer 2002, another component communicatively linked to the network 2003 (whether illustrated or not), or a combination of the computer 2002 and another component. For example, database 2006 can be an in-memory, conventional, or another type of database storing data consistent with the present disclosure. In some implementations, database 2006 can be a combination of two or more different database types (for example, a hybrid in-memory and conventional database) according to particular needs, desires, or particular implementations of the computer 2002 and the described functionality. Although illustrated as a single database 2006 in FIG. 20, two or more databases of similar or differing types can be used according to particular needs, desires, or particular implementations of the computer 2002 and the described functionality. While database 2006 is illustrated as an integral component of the computer 2002, in alternative implementations, database 2006 can be external to the computer 2002. As illustrated, the database 2006 can hold the previously described data 2016 including, for example, measurement logs, and core analysis results.

The computer 2002 also includes a memory 2007 that can hold data for the computer 2002, another component or components communicatively linked to the network 2003 (whether illustrated or not), or a combination of the computer 2002 and another component. Memory 2007 can store any data consistent with the present disclosure. In some implementations, memory 2007 can be a combination of two or more different types of memory (for example, a combination of semiconductor and magnetic storage) according to particular needs, desires, or particular implementations of the computer 2002 and the described functionality. Although illustrated as a single memory 2007 in FIG. 20, two or more memories 2007 or similar or differing types can be used according to particular needs, desires, or particular implementations of the computer 2002 and the described functionality. While memory 2007 is illustrated as an integral component of the computer 2002, in alternative implementations, memory 2007 can be external to the computer 2002.

The application 2008 is an algorithmic software engine providing functionality according to particular needs, desires, or particular implementations of the computer 2002, particularly with respect to functionality described in the present disclosure. For example, application 2008 can serve as one or more components, modules, or applications. Further, although illustrated as a single application 2008, the application 2008 can be implemented as multiple applications 2008 on the computer 2002. In addition, although illustrated as integral to the computer 2002, in alternative implementations, the application 2008 can be external to the computer 2002.

The computer 2002 can also include a power supply 2014. The power supply 2014 can include a rechargeable or non-rechargeable battery that can be configured to be either user- or non-user-replaceable. In some implementations, the power supply 2014 can include power-conversion or management circuits (including recharging, standby, or another power management functionality). In some implementations, the power-supply 2014 can include a power plug to allow the computer 2002 to be plugged into a wall socket or another power source to, for example, power the computer 2002 or recharge a rechargeable battery.

There can be any number of computers 2002 associated with, or external to, a computer system containing computer 2002, each computer 2002 communicating over network 2003. Further, the term "client," "user," or other appropriate terminology can be used interchangeably, as appropriate, without departing from the scope of the present disclosure. Moreover, the present disclosure contemplates that many users can use one computer 2002, or that one user can use multiple computers 2002.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal, for example, a machine-generated electrical, optical, or electromagnetic signal that is generated to encode information for transmission to a receiver apparatus for execution by a data processing apparatus. The computer-storage medium can be a machine-readable storage device, a machine-readable storage substrate, a random or serial access memory device, or a combination of computer-storage mediums. Configuring one or more computers means that the one or more computers have installed hardware, firmware, or software (or combinations of hardware, firmware, and software) so that when the software is executed by the one or more computers, particular computing operations are performed.

The term "real-time," "real time," "realtime," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second (s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be, or further include special purpose logic circuitry, for example, a central processing unit (CPU), an FPGA (field programmable gate array), or an ASIC (application-specific integrated circuit). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with an operating system of some type, for example LINUX, UNIX, WINDOWS, MAC OS, ANDROID, IOS, another operating system, or a combination of operating systems.

A computer program, which can also be referred to or described as a program, software, a software application, a unit, a module, a software module, a script, code, or other component can be written in any form of programming language, including compiled or interpreted languages, or declarative or procedural languages, and it can be deployed in any form, including, for example, as a stand-alone program, module, component, or subroutine, for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network.

While portions of the programs illustrated in the various figures can be illustrated as individual components, such as units or modules, that implement described features and functionality using various objects, methods, or other processes, the programs can instead include a number of sub-units, sub-modules, third-party services, components, libraries, and other components, as appropriate. Conversely, the features and functionality of various components can be combined into single components, as appropriate. Thresholds used to make computational determinations can be statically, dynamically, or both statically and dynamically determined.

Described methods, processes, or logic flows represent one or more examples of functionality consistent with the present disclosure and are not intended to limit the disclosure to the described or illustrated implementations, but to be accorded the widest scope consistent with described principles and features. The described methods, processes, or logic flows can be performed by one or more programmable computers executing one or more computer programs to perform functions by operating on input data and generating output data. The methods, processes, or logic flows can also be performed by, and apparatus can also be implemented as, special purpose logic circuitry, for example, a CPU, an FPGA, or an ASIC.

Computers for the execution of a computer program can be based on general or special purpose microprocessors, both, or another type of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable memory storage device.

Non-transitory computer-readable media for storing computer program instructions and data can include all forms of media and memory devices, magnetic devices, magneto optical disks, and optical memory device. Memory devices include semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Magnetic devices include, for example, tape, cartridges, cassettes, internal/removable disks. Optical memory devices include, for example, digital video disc (DVD), CD-ROM, DVD+/−R, DVD-RAM, DVD-ROM, HD-DVD, and BLURAY, and other optical memory technologies. The memory can store various objects or data, including caches, classes, frameworks, applications, modules, backup data, jobs, web pages, web page templates, data structures, database tables, repositories storing dynamic information, or other appropriate information including any parameters, variables, algorithms, instructions, rules, constraints, or references. Additionally, the memory can include other appropriate data, such as logs, policies, security or access data, or reporting files. The processor and the memory can be supplemented by, or incorporated in, special purpose logic circuitry.

To provide for interaction with a user, implementations of the subject matter described in this specification can be implemented on a computer having a display device, for example, a CRT (cathode ray tube), LCD (liquid crystal display), LED (Light Emitting Diode), or plasma monitor, for displaying information to the user and a keyboard and a pointing device, for example, a mouse, trackball, or trackpad by which the user can provide input to the computer. Input can also be provided to the computer using a touchscreen, such as a tablet computer surface with pressure sensitivity, a multi-touch screen using capacitive or electric sensing, or another type of touchscreen. Other types of devices can be used to interact with the user. For example, feedback provided to the user can be any form of sensory feedback. Input from the user can be received in any form, including acoustic, speech, or tactile input. In addition, a computer can interact with the user by sending documents to and receiving documents from a client computing device that is used by the user.

The term "graphical user interface," or "GUI," can be used in the singular or the plural to describe one or more graphical user interfaces and each of the displays of a particular graphical user interface. Therefore, a GUI can represent any graphical user interface, including but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with the present disclosure), all or a portion of the Internet, another communication network, or a combination of communication networks. The communication network can communicate with, for example, Internet Protocol (IP) packets, Frame Relay frames, Asynchronous Transfer Mode (ATM) cells, voice, video, data, or other information between networks addresses.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of what can be claimed, but rather as descriptions of features that can be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features can be described as acting in certain combinations and even initially claimed as such, one or more features from a claimed combination can, in some cases, be excised from the combination, and the claimed combination can be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations can be considered optional), to achieve desirable results. In certain circumstances, multitasking or parallel processing (or a combination of multitasking and parallel processing) can be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A computer-implemented method for characterizing a productive zone at a carbonate reservoir, the method comprising:

accessing, from a server computer, a first input stream of measurements obtained when drilling at a well location of a carbonate reservoir, the first input stream comprising data encoding a flow meter profile and a ratio of water and oil (WOR) at each depth of a range of depths;

accessing, from the server computer, a second input stream of measurements obtained from each depth within the range of depths at the well location;

based on the second input stream of measurements, determining a relationship of measured permeability and measured porosity at each depth within the range of depths at the well location;

based on the first input stream of measurements, analyzing the WOR to determine a derivative of the WOR termed as WOR' and defined as dWOR/dt as a function of time at each depth within the range of depths;

identifying at least one productive zone at the well location based on a combination of the WOR, the WOR', the flow meter profile, and the relationship of measured permeability and measured porosity at each depth within the range of depths such that the at least one productive zone is identified despite swings in the measured permeability, the measured porosity, and the flow meter profile that would otherwise lead to varied characterization of the at least one productive zone; and responsive to identifying the at least one productive zone, transmitting, to a display device, information encoding the WOR, the WOR', the flow meter profile, the measured permeability, and the measured porosity so that changes of wellbore conditions at the identified at least one productive zone of the well location inside the carbon reservoir are visually monitored as a function of time at the display device while the first and second input streams of measurements arrive at the server computer.

2. The computer-implemented method of claim 1, further comprising:

determining a distribution of reservoir quality index (RQI), and a distribution of normalized porosity index (NPI) based on the relationship of measured permeability and measured porosity at each depth within the range of depths.

3. The computer-implemented method of claim 2, further comprising:

determining a distribution of flow zone indicator (FZI) based on the distribution of RQI and the distribution of NPI at each depth within the range of depths.

4. The computer-implemented method of claim 3, wherein the combination further includes the distribution of RQI, the distribution of NPI, and the distribution of FZI.

5. The computer-implemented method of claim 1, wherein the combination further includes a cumulative distribution of the WOR, and a cumulative distribution of the WOR' within the range of depths.

6. The computer-implemented method of claim 1, wherein the flow meter profile is represented as a percentage of total flow within the range of depths.

7. The computer-implemented method of claim 1, further comprising:

establishing a database of productive zones characterized based on the combination of the WOR, the WOR', the flow meter profile, and the relationship of permeability and porosity at each depth within the range of depths.

8. The computer-implemented method of claim 7, further comprising:

correlating the database of productive zones with actual production logs;

refining the combination of the WOR, the WOR', the flow meter profile, and the relationship of permeability and porosity based on correlation results; and characterizing at least one productive zone at the well location based on the refined combination.

9. A computer system comprising one or more computer processors configured to perform operations of:

accessing, from the computer system, a first input stream of measurements obtained when drilling at a well location of a carbonate reservoir, the first input stream comprising data encoding a flow meter profile and a ratio of water and oil (WOR) at each depth of a range of depths;

accessing, from the computer system, a second input stream of measurements obtained from each depth within the range of depths at the well location;

based on the second input stream of measurements, determining a relationship of measured permeability and measured porosity at each depth within the range of depths at the well location;

based on the first input stream of measurements, analyzing the WOR to determine a derivative of the WOR termed as WOR' and defined as dWOR/dt as a function of time at each depth within the range of depths;

identifying at least one productive zone at the well location based on a combination of the WOR, the WOR', the flow meter profile, and the relationship of measured permeability and measured porosity at each depth within the range of depths such that the at least one productive zone is identified despite swings in the measured permeability, the measured porosity, and the flow meter profile that would otherwise lead to varied characterization of the at least one productive zone; and responsive to identifying the at least one productive zone, transmitting, to a display device, information encoding the WOR, the WOR', the flow meter profile, the measured permeability, and the measured porosity so that changes of wellbore conditions at the identified at least one productive zone of the well location inside the carbon reservoir are visually monitored as a function of time at the display device while the first and second input streams of measurements arrive at the computer system.

10. The computer system of claim 9, wherein the operations further comprise:

determining a distribution of reservoir quality index (RQI), and a distribution of normalized porosity index (NPI) based on the relationship of measured permeability and measured porosity at each depth within the range of depths.

11. The computer system of claim 10, wherein the operations further comprise:

determining a distribution of flow zone indicator (FZI) based on the distribution of RQI and the distribution of NPI at each depth within the range of depths.

12. The computer system of claim 11, wherein the combination further includes the distribution of RQI, the distribution of NPI, and the distribution of FZI.

13. The computer system of claim 9, wherein the combination further includes a cumulative distribution of the WOR, and a cumulative distribution of the WOR' within the range of depths.

14. The computer system of claim 9, wherein the flow meter profile is represented as a percentage of total flow within the range of depths.

15. The computer system of claim 9, wherein the operations further comprise:

establishing a database of productive zones characterized based on the combination of the WOR, the WOR', the flow meter profile, and the relationship of permeability and porosity at each depth within the range of depths.

16. The computer system of claim 15, wherein the operations further comprise:

correlating the database of productive zones with actual production logs;

refining the combination of the WOR, the WOR', the flow meter profile, and the relationship of permeability and porosity based on correlation results; and characterizing at least one productive zone at the well location based on the refined combination.

17. A non-transitory computer-readable medium, comprising software instructions, which, when executed by a computer processor, causes the computer processor to perform operations of:

accessing, from the computer processor, a first input stream of measurements obtained when drilling at a well location of a carbonate reservoir, the first input stream comprising data encoding a flow meter profile and a ratio of water and oil (WOR) at each depth of a range of depths;

accessing, from the computer processor, a second input stream of measurements obtained from each depth within the range of depths at the well location;

based on the second input stream of measurements, determining a relationship of measured permeability and measured porosity at each depth within the range of depths at the well location;

based on the first input stream of measurements, analyzing the WOR to determine a derivative of the WOR termed as WOR' and defined as dWOR/dt as a function of time at each depth within the range of depths;

identifying at least one productive zone at the well location based on a combination of the WOR, the WOR', the flow meter profile, and the relationship of measured permeability and measured porosity at each depth within the range of depths such that the at least one productive zone is identified despite swings in the measured permeability, the measured porosity, and the flow meter profile that would otherwise lead to varied characterization of the at least one productive zone; and responsive to identifying the at least one productive zone, transmitting, to a display device, information encoding the WOR, the WOR', the flow meter profile, the measured permeability, and the measured porosity so that changes of wellbore conditions at the identified at least one productive zone of the well location inside the carbon reservoir are visually monitored as a function of time at the display device while the first and second input streams of measurements arrive at the computer processor.

18. The non-transitory computer-readable medium of claim 17, wherein the operations further comprise:

determining a distribution of reservoir quality index (RQI), and a distribution of normalized porosity index (NPI) based on the relationship of measured permeability and measured porosity at each depth within the range of depths, and determining a distribution of flow zone indicator (FZI) based on the distribution of RQI and the distribution of NPI at each depth within the range of depths, wherein the combination further includes the distribution of RQI, the distribution of NPI, and the distribution of FZI.

19. The non-transitory computer-readable medium of claim 17, wherein the combination further includes a cumulative distribution of the WOR, and a cumulative distribution of the WOR' within the range of depths, and wherein the flow meter profile is represented as a percentage of total flow within the range of depths.

20. The non-transitory computer-readable medium of claim 17, wherein the operations further comprise:

establishing a database of productive zones characterized based on the combination of the WOR, the WOR', the flow meter profile, and the relationship of permeability and porosity at each depth within the range of depths;

correlating the database of productive zones with actual production logs;

refining the combination of the WOR, the WOR', the flow meter profile, and the relationship of permeability and porosity based on correlation results; and characterizing at least one productive zone at the well location based on the refined combination.

* * * * *